US009753384B2

(12) United States Patent
Kurimoto et al.

(10) Patent No.: US 9,753,384 B2
(45) Date of Patent: Sep. 5, 2017

(54) PHOTOCONDUCTOR, ELECTROPHOTOGRAPHIC METHOD, ELECTROPHOTOGRAPHIC APPARATUS, AND ELECTROPHOTOGRAPHIC PROCESS CARTRIDGE

(71) Applicants: Eiji Kurimoto, Shizuoka (JP); Tetsuro Suzuki, Shizuoka (JP); Tomoharu Asano, Kanagawa (JP); Daisuke Nii, Shizuoka (JP); Toshihiro Ishida, Shizuoka (JP)

(72) Inventors: Eiji Kurimoto, Shizuoka (JP); Tetsuro Suzuki, Shizuoka (JP); Tomoharu Asano, Kanagawa (JP); Daisuke Nii, Shizuoka (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/133,915

(22) Filed: Apr. 20, 2016

(65) Prior Publication Data

US 2016/0327877 A1 Nov. 10, 2016

(30) Foreign Application Priority Data

May 8, 2015 (JP) ..... 2015-095866

(51) Int. Cl.
*G03G 5/00* (2006.01)
*G03G 5/05* (2006.01)
(Continued)

(52) U.S. Cl.
CPC ..... *G03G 5/0517* (2013.01); *G03G 5/0507* (2013.01); *G03G 5/144* (2013.01); *G03G 15/75* (2013.01); *G03G 21/18* (2013.01)

(58) Field of Classification Search
CPC ..... G03G 5/144
(Continued)

(56) References Cited

U.S. PATENT DOCUMENTS

2006/0014092 A1 1/2006 Nukada et al.
2006/0014093 A1 1/2006 Li et al.
(Continued)

FOREIGN PATENT DOCUMENTS

JP 07-077818 3/1995
JP 08-166679 6/1996
(Continued)

OTHER PUBLICATIONS

U.S. Appl. No. 14/945,498, filed Nov. 19, 2015.
U.S. Appl. No. 14/933,413, filed Nov. 5, 2015.

*Primary Examiner* — Mark A Chapman
(74) *Attorney, Agent, or Firm* — Oblon, McClelland, Maier & Neustadt, L.L.P.

(57) ABSTRACT

Provided is a photoconductor including a conductive support, an intermediate layer containing metal oxide particles, and a photoconductive layer. The intermediate layer and the photoconductive layer are provided over the conductive support in the order of reciting. An elastic power (We/Wt value) of the intermediate layer is greater than or equal to 20.0% but less than 35.0%. A Martens hardness (HM) of the intermediate layer is greater than or equal to 350 [N/mm$^2$] but less than 450 [N/mm$^2$].

8 Claims, 7 Drawing Sheets

(51) Int. Cl.

| | |
|---|---|
| ***G03G 5/14*** | (2006.01) |
| ***G03G 15/00*** | (2006.01) |
| *G03G 21/18* | (2006.01) |

(58) Field of Classification Search
USPC ..... 430/60, 63, 65
See application file for complete search history.

(56) References Cited

U.S. PATENT DOCUMENTS

| | | | | |
|---|---|---|---|---|
| 2007/0065741 | A1* | 3/2007 | Iemura ..... | G03G 5/047 430/60 |
| 2013/0243506 | A1 | 9/2013 | Ikuno et al. | |
| 2014/0342276 | A1 | 11/2014 | Murakami et al. | |
| 2015/0168856 | A1 | 6/2015 | Kurimoto et al. | |
| 2015/0309430 | A1 | 10/2015 | Nii et al. | |

FOREIGN PATENT DOCUMENTS

| | | |
|---|---|---|
| JP | 11-133649 | 5/1999 |
| JP | 3669423 | 4/2005 |
| JP | 2005-141027 | 6/2005 |
| JP | 2005-227396 | 8/2005 |
| JP | 2006-030700 | 2/2006 |
| JP | 2012-058597 | 3/2012 |
| JP | 2013-072986 | 4/2013 |
| JP | 2013-137526 | 7/2013 |
| JP | 2013-190555 | 9/2013 |

* cited by examiner

PHOTOCONDUCTOR, ELECTROPHOTOGRAPHIC METHOD, ELECTROPHOTOGRAPHIC APPARATUS, AND ELECTROPHOTOGRAPHIC PROCESS CARTRIDGE

CROSS-REFERENCE TO RELATED APPLICATIONS

The present application claims priority under 35 U.S.C. §119 to Japanese Patent Application No. 2015-095866, filed May 8, 2015. The contents of which are incorporated herein by reference in their entirety.

BACKGROUND OF THE INVENTION

Field of the Invention

The present disclosure relates to photoconductors and electrophotographic methods, electrophotographic apparatuses, and electrophotographic process cartridges using the photoconductors.

Description of the Related Art

Images output by electrophotographic methods using electrophotographic apparatuses are formed by subjecting photoconductors (also referred to as electrophotographic photoconductors, electrostatic latent image bearers, and image bearers) to a charging step, an exposing step, a developing step, a transferring step, etc. In recent years, organic photoconductors using organic materials are widely used as photoconductors with such advantages as flexibility, thermal stability, a film forming property, etc.

The mainstream type of recent organic photoconductors are functionally-separated laminated photoconductors obtained by laminating a charge generating layer containing a charge generating substance and a charge transport layer containing a charge transport substance as photoconductive layers over a conductive support in order. Particularly, there have been proposed many negatively-chargeable photoconductors using a layer obtained by dispersing an organic pigment as a charge generating substance in a vapor-deposited layer or a resin as a charge generating layer and a layer obtained by dispersing an organic low-molecular compound as a charge transport substance in a resin as a charge transport layer. Further, there is also proposed a technique for providing an intermediate layer (may also be referred to as undercoat layer) between a conductive support and a photoconductive layer in order to suppress charges from being injected from the conductive support.

There is a need for organic photoconductors to have greater degrees of durability and stability along with rapid advancement in full-color, high-speed, and high-definition properties of electrophotographic apparatuses. However, through the current electrophotographic process in which charging and charge elimination are repeated, the organic material constituting the organic photoconductors undergoes a gradual change due to electrostatic loads, leading to degradation of electrophotographic properties, such as occurrence of charge traps in the layer and change of chargeability.

Particularly, degradation of chargeability due to changes of the properties of the organic photoconductor is known to have a great impact on image qualities of output images and cause serious problems such as image density degradation, background fog (may also be referred to as fogging commonly), and image nonuniformity in continuous outputting.

One contributory factor behind degradation of chargeability is considered to be functional insufficiency of the intermediate layer and deterioration of the intermediate layer due to repeated use. Generally, there is a need for the intermediate layer to fulfill simultaneously and maintain two functions including "a charge injection inhibiting function" for inhibiting charge injection from the conductive support into the photoconductive layer and "a charge transport function" for transporting charges generated in the photoconductive layer into the conductive support. However, the two functions are likely to fall into the relationship of reciprocity. Furthermore, the organic material constituting the intermediate layer deteriorates under repetitive electrostatic loads. Therefore, it is very hard for the intermediate layer to fulfill simultaneously and maintain the two functions described above for a long term.

As a method for imparting the functions described above to the intermediate layer, there are proposed methods for improving the charge injection inhibiting function using a silane coupling agent containing an amino group (see, e.g., Japanese Unexamined Patent Application Publication Nos. 08-166679 and 11-133649) and methods for adding additives such as an electron transport substance and an acceptor compound to the intermediate layer (see, e.g., Japanese Unexamined Patent Application Publication Nos. 2012-58597 and 2006-30700).

Particularly, Japanese Unexamined Patent Application Publication No. 2006-30700 proposes that an undercoat layer containing metal oxide particles to which an acceptor compound (e.g., a hydroxyanthraquinone-based compound and an aminohydroxyanthraquinone-based compound.) is attached be provided over the conductive support.

However, the hydroxyanthraquinone-based compound and the aminohydroxyanthraquinone-based compound have a high crystallinity. Therefore, when these compounds are attached to the metal oxide particles, the metal oxide particles are likely to agglomerate with each other. Hence, a dispersed state of the metal oxide particles in the intermediate layer is nonuniform. Therefore, it cannot be said that the intermediate layer has electric properties that are sufficiently stable through a long term of use.

Recent electrophotographic photoconductors have an improved wear resistance in a surface layer and a drastically prolonged durable life against a mechanical wear. However, a factor that determines the life of the electrophotographic photoconductors has become how long the electrophotographic photoconductors maintain requisite electric properties as electrophotographic photoconductors, i.e., chargeability in a dark place and a quick optical attenuating property during exposure.

As described above, there is a need for the intermediate layer to fulfill simultaneously and maintain the two functions including "the charge injection inhibiting function" for inhibiting charge injection from the conductive support into the photoconductive layer and "the charge transport function" for transporting charges generated in the photoconductive layer into the conductive support. However, there will occur a problem that traps to inhibit charge flows are increased in the layer through a long term of repeated use to raise the electric potential of an exposed portion and make it impossible to obtain a sufficient electrostatic contrast between the exposed portion and a non-exposed portion to degrade the density of output images. Further, abnormal images including a blackened background, etc. will be produced due to local leaks of charges. Through these factors, the electrophotographic photoconductors come to an end of life.

SUMMARY OF THE INVENTION

Provided is a photoconductor including a conductive support, an intermediate layer containing metal oxide particles, and a photoconductive layer. The intermediate layer and the photoconductive layer are provided over the conductive support in the order of reciting. An elastic power (We/Wt value) of the intermediate layer is greater than or equal to 20.0% but less than 35.0%. A Martens hardness (HM) of the intermediate layer is greater than or equal to 350 [N/mm$^2$] but less than 450 [N/mm$^2$].

DESCRIPTION OF THE EMBODIMENTS

Figure 1:
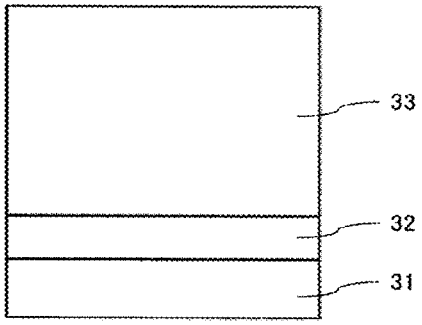
FIG. 1 is a cross-sectional view illustrating an example configuration of a photoconductor of the present invention.

The present invention has an object to provide a photoconductor capable of suppressing image density degradation and background fog without causing a rise in an electric potential of an exposed portion even through a long term of use.

The present invention can provide a photoconductor capable of suppressing image density degradation and background fog without causing a rise in an electric potential of an exposed portion even through a long term of use.

As a result of earnest studies, the present inventors have found that an electrophotographic photoconductor can suppress image density degradation and background fog without causing a rise in an electric potential of an exposed portion even through a long term of use when an intermediate layer containing metal oxide particles and a photoconductive layer are provided in the order of reciting over a conductive support of the electrophotographic photoconductor and an elastic power (We/Wt value) and a Martens hardness (HM) of the intermediate layer are set within specific ranges.

Specifically, the present inventors have found that when an elastic power (We/Wt), which is a ratio between We representing a workload of elastic deformation of the intermediate layer and Wt representing a workload of total deformation of the intermediate layer in an indenting test, is greater than or equal to 20.0% but less than 35.0% and a Martens hardness (HM) of the intermediate layer is greater than or equal to 350 [N/mm$^2$] but less than 450 [N/mm$^2$], close adhesiveness between the conductive support and the intermediate layer is significantly improved, occurrence of image flaws due to local pinhole leaks of charges can be significantly suppressed even when an internal stress in the photoconductive layer provided over the intermediate layer during formation of the photoconductive layer is high, and a rise in an electric potential of an exposed portion through repeated use can be suppressed.

Particularly, in the present invention, it is preferable that the intermediate layer contain zinc oxide particles coated with a salicylic acid derivative and a thermosetting resin.

Here, when zinc oxide particles that are not treated to have a coating over the surface are used, charge traps are likely to occur at the interface between the surface of the zinc oxide particles and the thermosetting resin. This makes it likely to cause a rise in an electric potential of an exposed portion along with repeated use and may cause abnormity in image density. When the zinc oxide particles are coated by a surface treatment with various types of hitherto used silane coupling agents, sufficient properties are exhibited in an initial period but charge traps occur through a long term of repeated use particularly under high temperature, high humidity conditions, leading to a rise in an electric potential of an exposed portion and abnormity in image density. As a result of further studies made by the present inventors, it has turned out that these problems are likely to be overcome with a surface coating treatment over the zinc oxide particles with a salicylic acid derivative, but that this treatment alone is not sufficient. As a result of various studies, what has turned out to matter is that the intermediate layer satisfy appropriate physical properties as a film in terms of adhesiveness (close adhesiveness) with the conductive support and interaction with the photoconductive layer provided as an upper layer. Particularly, it has turned out that use of zinc oxide particles coated with a salicylic acid derivative in the intermediate layer and setting of the elastic power (We/Wt value) and Martens hardness (HM) of the intermediate layer in the specific ranges as described above result in further improvement of the effect of the present invention.

In the present invention, the elastic power (We/Wt value) and Martens hardness (HM) of the intermediate layer are measured under the following conditions.

Evaluator: FISCHERSCOPE H-100

Testing method: repeating of loading and unloading (once)

Testing indenter: a micro Vickers indenter

Maximum load: 9.8 mN

Loading (unloading) time: 30 sec

Retention time: 5 sec

Measuring conditions: 23° C./55% RH

Note that a support for the measurement is not particularly limited to a glass plate, an Al plate, an Al cylinder, etc.

In the present invention, the elastic power of the intermediate layer is measured according to a loading-unloading test with a micro surface hardness meter using a micro Vickers indenter.

Figure 11A:
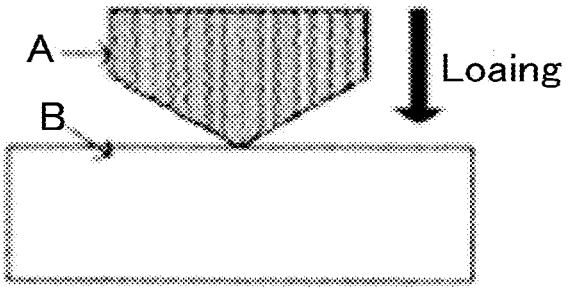
FIG. 11A is a diagram illustrating a method for measuring an elastic power of an intermediate layer of the present invention (part 1)
Figure 11B:
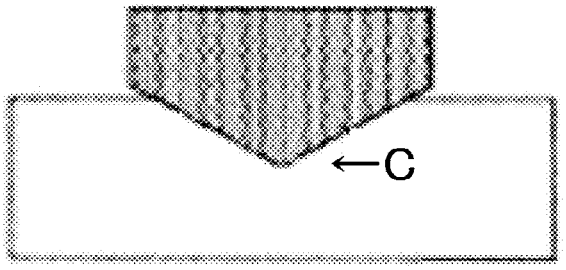
FIG. 11B is a diagram illustrating a method for measuring an elastic power of an intermediate layer of the present invention (part 2)
Figure 11C:
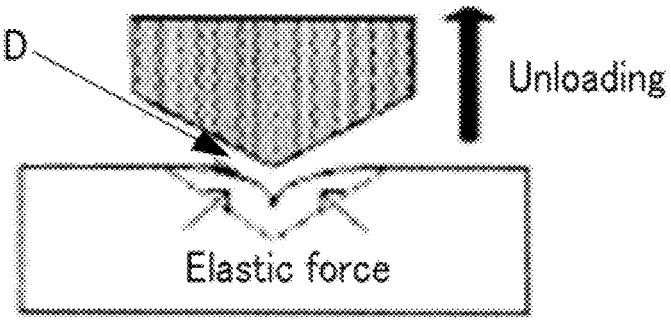
FIG. 11C is a diagram illustrating a method for measuring an elastic power of an intermediate layer of the present invention (part 3)

As illustrated in FIG. 11A to FIG. 11C, an indenter A is indented at a certain loading speed from a point at which the indenter A contacts a sample B (FIG. 11A) (loading process), left still for a certain time at a point of a maximum displacement C (FIG. 11B) when a set load is reached, and then lifted up at a certain unloading speed (unloading process). A point at which the indenter is finally released from the load is determined as a plastic displacement D (FIG. 11C).

Figure 12:
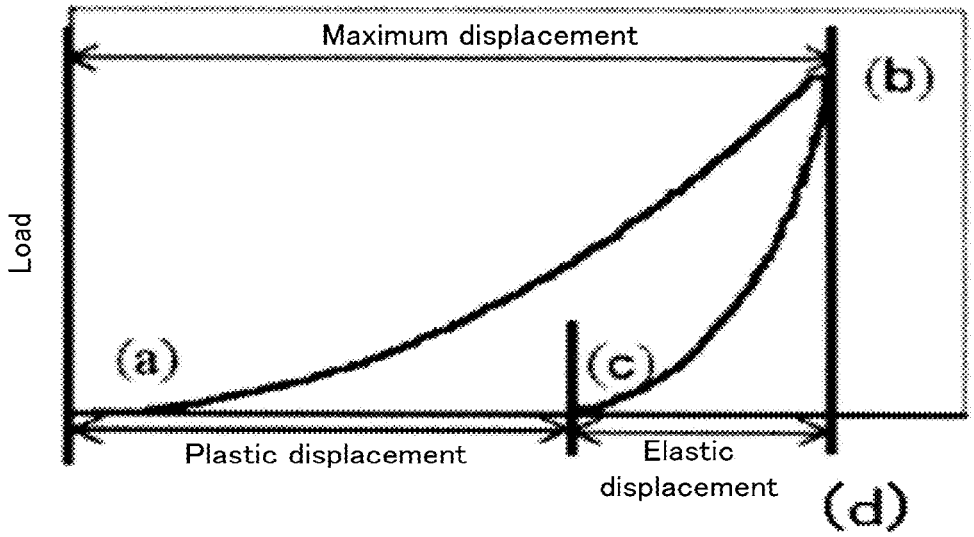
FIG. 12 is a graph illustrating a method for measuring an elastic power of an intermediate layer of the present invention.

In FIG. 12, a curve from (a) to (b) is a curve corresponding to the indenting of the indenter and the point (b) indicates the point (maximum displacement) reached when the indenter has reached the maximum indenting depth set. In FIG. 12, a curve from (b) to (c) is a curve corresponding to "returning" after the indenter is indented. A point (d) is a point of intersection at which a perpendicular drawn to the horizontal axis from the point (b) and the horizontal axis intersect with each other.

In FIG. 12, the area of a portion enclosed by the curve from (a) to (b), a straight line from (b) to (d), and the horizontal axis corresponds to the total workload Wt in indenting. Likewise, the area of a portion enclosed by the curve from (b) to (c), the straight line from (b) to (d), and the horizontal axis corresponds to the workload We of elastic deformation workload.

By the intermediate layer being controlled to have an elastic power within a specific range, where the elastic power is a value expressing in percentage, a value obtained by dividing the above-described value We by the above-described value Wt, there occur no local pinholes and adhesiveness and close adhesiveness of the intermediate layer with the conductive support and the photosensitive layer are greatly improved.

As a result, the electrophotographic photoconductor of the present invention can obtain an effect of suppressing charge leaks under various temperature/humidity conditions, particularly high-temperature, high-humidity conditions under which local charge leaks are likely to occur and background fog is likely to occur. Therefore, when used as an electrophotographic apparatus, the electrophotographic photoconductor is less susceptible to influence of the temperature/humidity conditions and can perform stable image formation.

When the elastic power (We/Wt value) of the intermediate layer is less than 20.0%, minute cracking is likely to occur due to an internal stress in the photoconductive layer provided over the intermediate layer during formation of the photoconductive layer and charge leaks due to local pinholes are likely to occur under high temperature, high humidity conditions, leading to a so-called background fog, which is a phenomenon in which black spot-like abnormal images occur and contaminate a background portion (non-image portion) during use in a reversely-developing image forming apparatus. When the elastic power of the intermediate layer is greater than or equal to 35.0%, charge accumulation is likely to occur through repeated use and a rise in an electric potential of an exposed portion occurs in an exposing step, leading to abnormity in image density.

The Martens hardness (HM) of the intermediate layer can be obtained according to ISO14577 by division by a surface area of the indenter obtained from the maximum indenting depth in the measurement of the elastic power. The Martens hardness (HM) also has a tendency. When the Martens hardness (HM) is less than 350 [N/mm$^2$], charge accumulation is likely to occur through repeated use and a rise in an electric potential of an exposed portion occurs in an exposing step. When the Martens hardness (HM) is greater than or equal to 450 [N/mm$^2$], minute cracking is likely to occur due to an internal stress in the photoconductive layer provided over the intermediate layer during formation of the photoconductive layer and charge leaks due to local pinholes are likely to occur under high temperature, high humidity conditions, leading to a so-called background fog, which is a phenomenon in which black spot-like abnormal images occur and contaminate a background portion (non-image portion) during use in a reversely-developing image forming apparatus.

The elastic power and Martens hardness of the intermediate layer can be adjusted by, for example, changing the kind of the metal oxide particles, changing the kind of the surface treatment over the metal oxide particles, changing a particle diameter distribution of the metal oxide particles, changing a dispersed state of the metal oxide particles in the intermediate layer, changing the blend of the metal oxide particles and a binder resin, changing the kind of a curable resin used as the binder resin, changing curing conditions (temperature and time) for curing the curable resin used as the binder resin, adding an additive such as a catalyst, etc.

The configuration of the photoconductor of the present invention will be described below with reference to the drawings.

FIG. 1 is a cross-sectional view illustrating an example configuration of the photoconductor of the present invention. An intermediate layer 32 of the present invention is provided over a conductive support 31 and a photoconductive layer 33 mainly made of a charge generating substance and a charge transport substance is provided over the intermediate layer 32.

Figure 2:
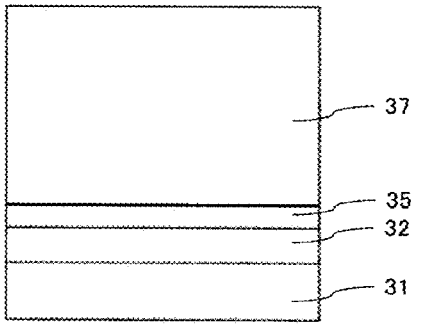
FIG. 2 is a cross-sectional view illustrating another example configuration of a photoconductor of the present invention.

FIG. 2 is a cross-sectional view illustrating another example configuration of the photoconductor of the present invention. An intermediate layer 32 of the present invention is provided over a conductive support 31 and a charge generating layer 35 mainly made of a charge generating substance and a charge transport layer 37 mainly made of a charge transport substance are laminated over the intermediate layer 32.

Figure 3:
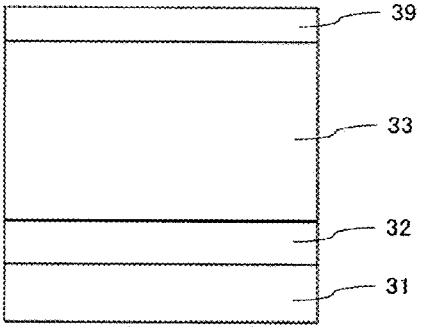
FIG. 3 is a cross-sectional view illustrating yet another example configuration of a photoconductor of the present invention.

FIG. 3 is a cross-sectional view illustrating yet another example configuration of the photoconductor of the present invention. An intermediate layer 32 of the present invention is provided over a conductive support 31, a photoconductive layer 33 mainly made of a charge generating substance and a charge transport substance is provided over the intermediate layer 32, and a protective layer 39 is further provided over the surface of the photoconductive layer.

Figure 4:
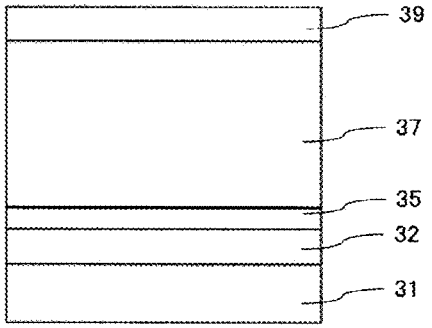
FIG. 4 is a cross-sectional view illustrating still another example configuration of a photoconductor of the present invention.

FIG. 4 is a cross-sectional view illustrating still another example configuration of the photoconductor of the present invention. An intermediate layer 32 of the present invention is provided over a conductive support 31, a charge generating layer 35 mainly made of a charge generating substance and a charge transport layer 37 mainly made of a charge transport substance are laminated over the intermediate layer 32, and a protective layer 39 is further provided over the charge transport layer.

First, the conductive support 31 will be described in detail.

A product having a conductivity represented by a volume resistance of less than or equal to $10^{10}$ Ω·cm, e.g., a product obtained by coating a film-like or cylindrical plastic or paper with a metal such as aluminium, nickel, chromium, nichrome, copper, gold, silver, and platinum or a metal oxide such as tin oxide and indium oxide by vapor deposition or sputtering, or a plate such as a plate of aluminium, an aluminium alloy, nickel, and stainless and a tube obtained by forming such a plate into a tube stock by extruding, drawing, etc. and surface-treating the tube stock by cutting, superfinishing, polishing, etc. can be used as the conductive support 31. An endless nickel belt and an endless stainless belt can also be used as the conductive support 31.

Moreover, a product obtained by applying a conductive powder dispersed in an appropriate binder resin over the support can also be used as the conductive support 31 of the present invention. Examples of the conductive powder include carbon black, acetylene black, metal powders of aluminium, nickel, iron, nichrome, copper, zinc, and silver, and metal oxide powders of conductive tin oxide and ITO. Examples of the binder resin used in combination include thermoplastic resins, thermosetting resins, and photocurable resins such as polystyrenes, styrene-acrylonitrile copolymers, styrene-butadiene copolymers, styrene-maleic anhydride copolymers, polyesters, polyvinyl chlorides, vinyl chloride-vinyl acetate copolymers, polyvinyl acetates, polyvinylidene chlorides, polyallylate resins, phenoxy resins, polycarbonates, cellulose acetate resins, ethyl cellulose resins, polyvinyl butyrals, polyvinyl formals, polyvinyl toluenes, poly-N-vinylcarbazoles, acrylic resins, silicone resins, epoxy resins, melamine resins, urethane resins, phenol resins, and alkyd resins Such a conductive layer can be formed by applying such conductive powder and binder resin as described above in a state of being dispersed in an appropriate solvent such as tetrahydrofuran, dichloromethane, methyl ethyl ketone, and toluene.

Furthermore, a product obtained by providing over an appropriate cylindrical base, a conductive layer in the form of a thermal shrinkage tube, which is a product containing the conductive powder in a material such as polyvinyl chlorides, polypropylenes, polyesters, polystyrenes, polyvinylidene chlorides, polyethylenes, chlorinated rubbers, and Teflon (registered trademark), can also be favorably used as the conductive support 31 of the present invention.

Next, the intermediate layer 32 of the present invention will be described.

There is a need that the intermediate layer 32 of the electrophotographic photoconductor described in the present invention have both of a function for suppressing injection of unnecessary charges (charges of an opposite polarity to a charging polarity to which the photoconductor is charged) into the photoconductive layer from the conductive support and a function for transporting charges of the same polarity as the charging polarity of the photoconductor among charges generated in the photoconductive layer.

For example, when there is a need for negatively charging the photoconductor as an electrophotographic process, there is a need that the intermediate layer have both of a hole injection inhibiting function (hole blocking property) for inhibiting hole injection into the photoconductive layer from the conductive support and an electron transport function (electron transport property) for transporting electrons from the photoconductive layer into the conductive support. Further, in order to obtain a photoconductor stable for a long term, what matters is that these properties not change even under repetitive electrostatic loads.

In the present invention, the intermediate layer 32 contains metal oxide particles and has an elastic power (We/Wt value) of greater than or equal to 20.0% but less than 35.0% and a Martens hardness (HM) of greater than or equal to 350 [N/mm$^2$] but less than 450 [N/mm$^2$] as described above.

In a preferable embodiment of the present invention, the intermediate layer 32 contains zinc oxide particles coated with a salicylic acid derivative and a thermosetting resin. Examples of metal oxide particles that can be used in the intermediate layer 32 other than zinc oxide particles include titanium oxide and tin oxide. However, the following description will be given by taking zinc oxide particles as an example of the metal oxide particles.

Zinc oxide particles coated with a salicylic acid derivative used in the present invention are formed by dispersing zinc oxide particles together with a thermosetting resin in an appropriate solvent and applying and drying the resultant over the conductive support.

Next, zinc oxide particles favorably used in the present invention will be described.

A known method is used as a method for producing zinc oxide particles used in the present invention. Above all, a method referred to as wet method is preferable. A wet method is roughly classified into two types. One is a method for neutralizing an aqueous solution of zinc sulfate or zinc chloride with a soda ash solution, washing the resultant zinc carbonate with water, drying the resultant, and calcining the resultant. Another is a method for producing zinc hydroxide, washing the zinc hydroxide with water, drying the resultant, and calcining the resultant. With zinc oxide produced according to these wet methods, it is possible to obtain zinc oxide used in the present invention easily.

Details of the wet method will be described below.

Specifically, the wet method is for producing a precipitate from a zinc aqueous solution and an alkaline aqueous solution, aging and washing the precipitate, wetting the precipitate with an alcohol, starting drying the resultant to obtain a zinc oxide particle precursor, and firing the zinc oxide particle precursor to zinc oxide particles.

Here, a zinc compound for preparing the zinc aqueous solution is not particularly limited and examples of the zinc compound include zinc nitrate, zinc chloride, zinc acetate, and zinc sulfate. Zinc sulfate is preferable in order for sulfur derived from a sulfuric acid to be contained in the zinc oxide used in the present invention.

Examples of the alkaline aqueous solution include aqueous solutions of sodium hydroxide, potassium hydroxide, ammonium hydrogen carbonate, and ammonia. Sodium hydroxide is preferable for a method for obtaining the zinc oxide used in the present invention. An alkali concentration of sodium hydroxide in the alkaline aqueous solution is preferably an excess concentration that is a multiple by a value in a range of from 1.0 time through 1.5 times of a chemical equivalent needed for the zinc compound to become a hydroxide. This is because a devoted amount of the zinc compound can react when the alkali is more than or equal to the chemical equivalent and a washing time taken for removing residual alkali is short when the excess concentration is less than or equal to a 1.5-times multiple.

Next, production and aging of a precipitate will be described.

The precipitate is produced by dropping an aqueous solution of the zinc compound into an alkaline aqueous solution continuously stirred. Immediately upon the aqueous solution of the zinc compound being dropped into the alkaline aqueous solution, a degree of supersaturation is reached to produce a precipitate. Hence, a precipitate of particles of zinc carbonate and zinc carbonate hydroxide having a uniform particle diameter can be obtained. It is difficult to obtain a precipitate of particles of zinc carbonate and zinc carbonate hydroxide having a uniform particle size as described above by dropping the alkaline solution into the aqueous solution of the zinc compound or by dropping the solution of the zinc compound and the alkaline solution in parallel. A temperature of the alkaline aqueous solution during production of the precipitate is not particularly limited, but is lower than or equal to 50° C., and is preferably room temperature. A lower limit of the temperature of the alkaline aqueous solution is not specified. However, an excessively low temperature needs a cooling device or the like. Therefore, a temperature that needs no such device is preferable. A dropping time for dripping the aqueous solution of the zinc compound into the alkaline aqueous solution is shorter than 30 minutes, preferably shorter than or equal to 20 minutes, and further preferably shorter than or equal to 10 minutes in terms of productivity. After dropping is completed, stirring is continued for aging in order to homogenize the system internally. An aging temperature is the same as the temperature during production of the precipitate. A time for which stirring is continued is not particularly limited, but is shorter than or equal to 30 minutes, and preferably shorter than or equal to 15 minutes in terms of productivity. The precipitate obtained after the aging is washed by decantation.

Next, the washed precipitate is treated by wetting with an alcohol solution and the wetting-treated product is dried to obtain a zinc oxide particle precursor. The wetting treatment can prevent aggregation of the zinc oxide particle precursor obtained after the drying. An alcohol concentration of the alcohol solution is preferably higher than or equal to 50% by mass. The alcohol concentration of higher than or equal to 50% by mass is preferable because the zinc oxide particles can avoid becoming a strong aggregate and have an excellent dispersibility. The alcohol solution used in the wetting treatment will be described. An alcohol used in the alcohol solution is not particularly limited but an alcohol soluble in water and having a boiling point of lower than or equal to 100° C. is preferable. Examples of the alcohol include methanol, ethanol, propanol, and tert-butyl alcohol.

The wetting treatment will be described.

The wetting treatment may be performed by putting the filtrated, washed precipitate into the alcohol solution and stirring the precipitate. Here, a time and a stirring speed may be appropriately selected according to the amount treated. The amount of the alcohol solution into which the precipitate is put may be a liquid amount that enables the precipitate to be stirred easily and can secure liquidity. A stirring time and the stirring speed are appropriately selected on the condition that the precipitate that may have been partially aggregated during the filtering and washing described above be uniformly mixed in the alcohol solution until the aggregation is resolved. The wetting treatment may typically be performed at normal temperature. However, as needed, the wetting treatment may also be performed while performing heating to a degree until which the alcohol does not evaporate and get lost. It is preferable to perform heating at a temperature lower than or equal to the boiling point of the alcohol. This makes it possible to avoid the alcohol dissipating during the wetting treatment and the wetting treatment being ineffective. Persistence of the presence of the alcohol during the wetting treatment is preferable because the effect of the wetting treatment can be enjoyed and the precipitate does not become a strong aggregate after dried.

Drying of the wetting-treated product will be described. Drying conditions such as a drying temperature and a time are not particularly limited and heating drying may be started in the state that the wetting-treated product is wet with the alcohol. The precipitate does not become a strong aggregate even when heating-dried so long as the heating drying is performed after the wetting treatment. Hence, drying conditions may be appropriately selected depending on the amount of the wetting-treated product treated, a treating apparatus, etc. Through the drying treatment, a zinc oxide particle precursor that has undergone the wetting treatment can be obtained. The precursor is fired to become zinc oxide particles. The zinc oxide precursor that has undergone the drying treatment is fired. The firing is performed under an atmosphere of an inert gas such as atmospheric air, nitrogen, argon, and helium or an atmosphere of a mixed gas between the inert gas described above and a reducing gas such as hydrogen. Here, a lower limit of a treating temperature is preferably around 400° C. in terms of a desired ultraviolet absorbing (shielding) property. A treating time is appropriately selected depending on the amount of the zinc oxide precursor treated and a firing temperature.

The zinc oxide particles used in the present invention preferably has an average particle diameter of greater than or equal to 50 nm but less than or equal to 200 nm. When the zinc oxide particles have a large diameter, there are relatively scarce zinc oxide particles in the intermediate layer with respect to the binder resin. When the zinc oxide particles have a small diameter, there are relatively many zinc oxide particles in the intermediate layer. Hence, when the diameter of the zinc oxide particles is greater than 200 nm, an inter-particle distance is long because the zinc oxide particles are scarce. This makes it harder for negative charges generated by the charge generating substance in the photoconductive layer described below to reach the substrate to make it likely for charge traps to be generated, leading to a tendency toward generation of abnormal images such as an afterimage. When the diameter of the zinc oxide particles is less than 50 nm, there are many zinc oxide particles in the intermediate layer. This makes it likely for charge leaks to occur, leading to a tendency toward occurrence of background fog.

A known method is used as a method for obtaining an average particle diameter of the zinc oxide particles. As an example, a randomly selected hundred particles among the particles observed in the intermediate layer are observed with a transmission electron microscope (TEM), projected areas of the particles are obtained, and circle equivalent diameters of the obtained areas are calculated to obtain a volume average particle diameter as the average particle diameter.

It is preferable that the zinc oxide particles used in the present invention be coated with a salicylic acid derivative. Examples of the salicylic acid derivative used in the present invention include salicylic acid, acetylsalicylic acid, 5-acetylsalicylic acid, 3-aminosalicylic acid, 5-acetylsalicylamide, 5-aminosalicylic acid, 4-azidosalicylic acid, benzyl salicylate, 4-tert-butylphenyl salicylate, butyl salicylate, 2-carboxyphenyl salicylate, 3,5-dinitrosalicylic acid, dithiosalicylic acid, ethyl acetylsalicylate, 2-ethylhexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid, methyl acetylsalicylate, methyl 5-acetylsalicylate, methyl 5-allyl-3-methoxysalicylate, methyl 5-formylsalicylate, methyl 4-(2-hydroxyethoxy)salicylate, methyl 3-methoxysalicylate, methyl 4-methoxysalicylate, methyl 5-methoxysalicylate, methyl 4-methylsalicylate, methyl 5-methylsalicylate, methyl salicylate, 3-methylsalicylic acid, 4-methylsalicylic acid, 5-methylsalicylic acid, methyl thiosalicylate, 4-nitrophenyl salicylate, 5-nitrosalicylic acid, 4-nitrosalicylic acid, 3-nitrosalicylic acid, 4-octylphenyl salicylate, phenyl salicylate, 3-acetoxy-2-naphthoanilide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2-naphthoate, phenyl 1,4-dihydroxy-2-naphthoate, and phenyl 1-hydroxy-2-naphthoate.

One of these salicylic acid derivatives may be used alone or two or more of these salicylic acid derivatives may be used as a mixture.

Next, a method for coating the zinc oxide particles with the salicylic acid derivative, i.e., a surface treatment over the zinc oxide particles will be described. First, an amount used for the surface treatment will be described. An amount of the salicylic acid derivative used for the treatment is preferably in a range of from 0.3% by mass through 6% by mass and more preferably in a range of from 1% by mass through 3% by mass of the zinc oxide particles. When the content of the salicylic acid derivative is less than 0.3% by mass of the zinc oxide particles, the function imparted by the salicylic acid derivative cannot be exhibited sufficiently and properties may not be obtained. When the content of the salicylic acid derivative is greater than 6% by mass of the zinc oxide particles, dispersion of the zinc oxide particles may be inhibited and sufficient properties may not be obtained. Any known method may be used as the method for the surface treatment with the salicylic acid derivative. A dry method or a wet method may be used.

When the surface treatment is performed by a dry method, the salicylic acid derivative, which may be as it is or in a state dissolved in an organic solvent, is dropped or sprayed with dry air or a nitrogen gas while the zinc oxide particles are stirred with a mixer or the like having a high shearing force. This realizes a uniform treatment. It is preferable to perform adding or spraying at a temperature lower than a boiling point of the solvent. It is not preferable to perform spraying at a temperature higher than or equal to the boiling point of the solvent, because there is a disadvantage that the solvent is evaporated before a uniformly stirred state is obtained to make the salicylic acid derivative form local lumps to make it harder to obtain a uniform treatment. After adding or spraying, it is further possible to perform baking at higher than or equal to 100° C. A temperature and a time for baking may be in arbitrary ranges so long as desired electrophotographic properties can be obtained.

A wet method is performed by stirring the zinc oxide particles in a solvent, dispersing the zinc oxide particles ultrasonically or with a sand mill, an attriter, a ball mill, or the like, adding a solution containing the salicylic acid derivative, stirring or dispersing the resultant, and removing the solvent. This realizes a uniform treatment. A method for removing the solvent may be filtration or evaporation by distillation. After the solvent removal, it is further possible to perform baking at higher than or equal to 100° C. A temperature and a time for baking may be in arbitrary ranges so long as desired electrophotographic properties can be obtained. In the wet method, it is possible to remove a water content contained in the zinc oxide particles before adding the surface treating agent. Examples of a usable method for the removal include a method for removing the water content while stirring and heating the zinc oxide particles in the solvent used in the surface treatment and a method for azeotropically boiling the water content with the solvent to remove the water content.

The intermediate layer 32 is formed with the use of a binder resin. A thermosetting resin, which is a resin having a high solvent resistance against common organic solvents, is selected as the binder resin considering that the photoconductive layer described below will be applied over the intermediate layer. Examples of such a resin include polyurethanes, melamine resins, phenol resins, and alkyd-melamine resins. One of these resins or two or more of these resins may be selected and used. An appropriate amount of the binder resin is in a range of from 10 parts by mass through 200 parts by mass and preferably in a range of from 20 parts by mass through 100 parts by mass relative to 100 parts by mass of the zinc oxide particles. The binder resin may be added before or after the dispersion of the zinc oxide particles. When the additive amount of the binder resin is excessively low, a favorably dispersed film of the zinc oxide particles cannot be formed. When the additive amount of the binder resin is excessively high, a preferable electron transport function cannot be exhibited.

A solvent used in an intermediate layer coating liquid is not particularly limited so long as the solvent is a commonly used solvent. Examples of the solvent include alcohol-based solvents such as methanol, ethanol, propanol, and butanol, ketone-based solvents such as acetone, methyl ethyl ketone, methyl isobutyl ketone, and cyclohexanone, ester-based solvents such as ethyl acetate and butyl acetate, ether-based solvents such as tetrahydrofuran, dioxane, propylether, halogen-based solvents such as dichloromethane, dichloroethane, trichloroethane, and chlorobenzene, aromatic solvents such as benzene, toluene, and xylene, and cellosolve-based solvents such as methylcellosolve, ethylcellosolve, and cellosolve acetate. One of these solvents may be used alone or two or more of these solvents may be used as a mixture.

A method for dispersing the metal oxide in the intermediate layer coating liquid may be a commonly industrially used method in an appropriate manner. For example, a ball mill, a sand mill, a vibrating mill, a KD mill, a three-roll mill, an attriter, a pressure homogenizer, ultrasonic dispersion, etc. may be used.

A coating method used for forming the intermediate layer is not particularly limited so long as the coating method is a commonly used coating method. An arbitrary coating method may be selected depending on a viscosity of the coating liquid, a desired film thickness of the intermediate layer, etc. Examples of usable coating methods include a dip coating method, spray coating, bead coating, and a ring coating method.

The intermediate layer 32 may be heating-dried with an oven or the like as needed after the intermediate layer 32 is applied using the coating liquid described above. A drying temperature for drying the intermediate layer is preferably in a range of from 80° C. through 200° C. and more preferably in a range of from 100° C. through 150° C. although the temperature varies depending on the kind of the solvent contained in the intermediate layer coating liquid. When the drying temperature is excessively low, a residual solvent may occur. When the drying temperature is excessively high, the organic material, etc. may deteriorate to make it impossible for the intermediate layer to perform the function favorably.

A film thickness of the intermediate layer 32 used in the present invention may be appropriately selected depending on desired electric properties and life of the electrostatic photoconductor. However, the film thickness is preferably greater than or equal to 10 μm but less than 50 μm and more preferably greater than or equal to 15 μm but less than or equal to 30 μm. When the intermediate layer is thin, charges of an opposite polarity to the charging polarity to which the surface of the electrophotographic photoconductor is charged flow into the photoconductive layer from the conductive support. This makes it likely to cause background fog-like image flaws due to a charging failure. In some case, it may be undesirable that the intermediate layer be excessively thick because there may occur problems such as degradation of an optical attenuating function due to a rise of a residual potential and degradation of repeating stability.

A ratio of the zinc oxide particles (metal oxide particles) in the intermediate layer 32 is, for example, in a range of from 90% by mass through 60% by mass and preferably in a range of from 85% by mass through 75% by mass.

Various additives may be used in the intermediate layer coating liquid in order to improve electric properties, environmental stability, and image qualities.

Examples of known materials that can be used as the additives include: electron transport substances such as quinone-based compounds (e.g., chloranil and bromanil), tetracyanoquinoclimethane-based compounds, fluorenone compounds (e.g., 2,4,7-trinitrofluorenone and 2,4,5,7-tetranitro-9-fluorenone), oxadiazole-based compounds (e.g., 2-(4-biphenyl)-5-(4-t-butylphenyl)-1,3,4-oxadiazole, 2,5-bis(4-naphtyl)-1,3,4-oxadiazole, and 2,5-bis(4-diethylaminophenyl)-1,3,4 oxadiazole), xanthone-based compounds, thiophene compounds, and diphenoquinone compounds (e.g., 3,3'5,5'-tetra-t-butyldiphenoquinone); electron transport pigments such as polycyclic condensate pigments and azo-pigments; zirconium chelate compounds; titanium chelate compounds; aluminium chelate compounds; titanium alkoxide compounds; organotitanium compounds; and silane coupling agents.

One of these compounds may be used alone or a plurality of compounds of these compounds may be used as a mixture or a polycondensate.

Next, the photoconductive layer will be described. The photoconductive layer may be a photoconductive layer having a single-layer configuration (FIG. 1 and FIG. 3) containing a charge generating substance and a charge transport substance or a laminated configuration (FIG. 2 and FIG. 4) constituted by a charge generating layer and a charge transport layer. For descriptive expediency, a photoconductive layer having a laminated configuration will be described first.

The charge generating layer 35 is a layer mainly made of a charge generating substance. A known charge generating substance may be used in the charge generating layer 35. Representative examples of the known charge generating substance include monoazo pigments, disazo pigments, trisazo pigments, perylene-based pigments, perinone-based pigments, quinacridone-based pigments, quinone-based condensed polycyclic compounds, squaric acid-based dyes, other phthalocyanine-based pigments, naphthalocyanine-based pigments, and azlenium salt-based dyes. One of these charge generating substances may be used alone or two or more of these charge generating substances may be used as a mixture.

The charge generating layer 35 is formed by subjecting the charge generating substance to dispersion in an appropriate solvent together with a binder resin as needed using a ball mill, an attriter, a sand mill, ultrasonic waves, etc., applying the resultant over the conductive support, and drying the resultant.

Examples of the binder resin used as needed include polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinylcarbazoles, polyacrylamides, polyvinylbenzals, polyesters, phenoxy resins, vinyl chloride-vinyl acetate copolymers, polyvinyl acetates, polyphenylene oxides, polyvinylpyridines, cellulose-based resins, casein, polyvinyl alcohols, and polyvinylpyrrolidones.

An appropriate amount of the binder resin is in a range of from 0 parts by mass through 500 parts by mass and preferably in a range of from 10 parts by mass through 300 parts by mass relative to 100 parts by mass of the charge generating substance.

The binder resin may be added before or after the dispersion. Examples of the solvent include isopropanol, acetone, methyl ethyl ketone, cyclohexanone, tetrahydrofuran, dioxane, ethylcellosolve, ethyl acetate, methyl acetate, dichloromethane, dichloroethane, monochlorobenzene, cyclohexane, toluene, xylene, and ligroin. It is particularly preferable to use ketone-based solvents, ester-based solvents, and ether-based solvents. One of these solvents may be used alone or two or more of these solvents may be used as a mixture.

The charge generating layer 35 is mainly made of the charge generating substance, the solvent, and the binder resin. The charge generating layer 35 may further contain various additives such as a sensitizer, a dispersant, a surfactant, and a silicone oil.

Examples of usable methods for applying a coating liquid include a dip coating method, spray coating, bead coating, nozzle coating, spinner coating, and ring coating.

An appropriate film thickness of the charge generating layer 35 is in a range of from about 0.01 μm through 5 μm and preferably in a range of from 0.1 μm through 2 μm.

The charge transport layer 37 is a layer mainly made of a charge transport substance. A hole transport substance may be used in the charge transport layer 37 as a known charge transport substance.

Examples of the hole transport substance include poly(N-vinylcarbazoles) and derivatives of the poly(N-vinylcarbazoles), poly(γ-carbazolylethylglutamates) and derivatives of the poly(γ-carbazolylethylglutamates), a pyrene-formaldehyde condensate and derivatives of the pyrene-formaldehyde condensate, polyvinylpyrenes, polyvinylphenanthrenes, polysilanes, oxazole derivatives, oxadiazole derivatives, imidazole derivatives, monoarylamine derivatives, diarylamine derivatives, triarylamine derivatives, stilbene derivatives, α-phenyl stilbene derivatives, aminobiphenyl derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. One of these charge transport substances are used alone or two or more of these charge transport substances are used as a mixture.

Examples of usable binder resins include thermoplastic or thermosetting resins such as polystyrenes, styrene-acrylonitrile copolymers, styrene-butadiene copolymers, styrene-maleic anhydride copolymers, polyesters, polyvinyl chlorides, vinyl chloride-vinyl acetate copolymers, polyvinyl acetates, polyvinylidene chlorides, polyallylates, phenoxy resins, polycarbonates, cellulose acetate resins, ethyl cellulose resins, polyvinyl butyrals, polyvinyl formals, polyvinyl toluenes, poly(N-vinylcarbazoles), acrylic resins, silicone resins, epoxy resins, melamine resins, urethane resins, phenol resins, and alkyd resins. Among these resins, polycarbonates and polyallylates are preferable. Examples of usable solvents include tetrahydrofuran, dioxane, toluene, cyclohexanone, methyl ethyl ketone, xylene, acetone, and diethylether. One of these solvents may be used alone or two or more of these solvents may be used as a mixture.

The charge transport layer is obtained by applying a coating liquid and heating-drying the applied coating liquid with an oven or the like.

In the present invention, a drying temperature for drying the charge transport layer is preferably in a range of from 80° C. through 150° C. and more preferably in a range of from 100° C. through 140° C. although the drying temperature varies depending on the kind of the solvent contained in the coating liquid for the charge transport layer.

An appropriate amount of the charge transport substance is in a range of from 20 parts by mass through 300 parts by mass and preferably in a range of from 40 parts by mass through 150 parts by mass relative to 100 parts by mass of the binder resin.

As needed, a plasticizer and a leveling agent may also be added. Examples of plasticizers usable as-is include plasticizers commonly used as plasticizers for resins, such as dibutyl phthalate and dioctyl phthalate. An appropriate amount of use of the plasticizer is in a range of from about 0 part by mass through 30 parts by mass relative to 100 parts by mass of the binder resin.

Examples of leveling agents usable in combination in the charge transport layer include silicone oils such as dimethyl silicone oils and methyl phenyl silicone oils and polymers or oligomers containing perfluoroalkyl groups on a side chain. An appropriate amount of use of the leveling agent is in a range of from about 0 part by mass through 1 part by mass relative to 100 parts by mass of the binder resin.

An appropriate film thickness of the charge transport layer is in a range of from about 5 μm through 40 μm and preferably in a range of from about 10 μm through 30 μm.

Next, a case where the photoconductive layer has a single-layer configuration (cases of FIG. 1 and FIG. 3) will be described.

The photoconductive layer 33 can be formed by dissolving or dispersing a charge generating substance, a charge transport substance, and a binder resin in an appropriate solvent, applying the resultant, and drying the resultant.

As needed, a plasticizer, a leveling agent, an antioxidant, etc. may also be added.

The materials (charge generating substance, charge transport substance, and binder resin) used in the laminated photoconductive layers (charge generating layer and charge transport layer) described above may likewise be used in the single-layered photoconductive layer 33. It is preferable to use an electron transport substance given below as the charge transport substance in combination in the single-layered photoconductive layer 33 for a higher sensitivity.

Examples of the electron transport substance include electron accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-inden[1,2-b]thiophen-4-one, 1,3,7-trinitrodibenzothiophene-5,5-dioxide, and benzoquinone derivatives.

In the single-layered photoconductive layer 33, an amount of the charge generating substance is in a range of from 0.1% by mass through 30% by mass and preferably in a range of from 0.5% by mass through 5% by mass of the whole photoconductive layer. When the concentration of the charge generating substance is low, there is a tendency toward degradation of the sensitivity of the photoconductor. When the concentration is high, there is a tendency toward degradation of chargeability and film strength.

A film thickness of the photoconductive layer 33 is preferably less than or equal to 50 μm and preferably less than or equal to 25 μm in terms of resolution and responsiveness. A lower limit of the film thickness is preferably greater than or equal to 5 μm although the lower limit varies depending on the system used (particularly, a charging potential, etc.).

In the photoconductor of the present invention, there may be a case when the protective layer 39 is provided over the photoconductive layer in order to protect the photoconductive layer. Examples of a material used in the protective layer 39 include resins such as ABS resins, ACS resins, olefin-vinyl monomer copolymers, chlorinated polyethers, aryl resins, phenol resins, polyacetals, polyamides, polyamide-imides, polyacrylates, polyallylsulfones, polybutylenes, polybutylene terephthalates, polycarbonates, polyethersulfones, polyethylenes, polyethylene terephthalates, polyimides, acrylic resins, polymethylpentenes, polypropylenes, polyphenylene oxides, polysulfones, polystyrenes, polyallylates, AS resins, butadiene-styrene copolymers, polyurethanes, polyvinyl chlorides, polyvinylidene chlorides, and epoxy resins. Polycarbonates or polyallylates are particularly effective and useful in terms of filler dispersibility, a residual potential, and flaws in an applied film.

A filler material can be added in the protective layer of the photoconductor in order to improve wear resistance.

Examples of usable solvents include all of the solvents that may be used in the charge transport layer 37, such as tetrahydrofuran, dioxane, toluene, dichloromethane, monochlorobenzene, dichloroethane, cyclohexanone, methyl ethyl ketone, and acetone. Note that a solvent having a high viscosity is preferable during dispersion but that a solvent having a high volatility is preferable during coating. When there is no available solvent that satisfies these conditions, it is possible to mix and use two or more kinds of solvents having the respective properties. This may provide a remarkable effect on filler dispersibility and a residual potential.

It is effective and useful to add any charge transport substance given as examples for the charge transport layer 37 in the protective layer in order to lower a residual potential and improve image qualities.

Examples of usable methods for forming the protective layer include hitherto used methods such as a clip coating method, spray coating, bead coating, nozzle coating, spinner coating, and ring coating. Spray coating is more preferable in terms of, particularly, uniformity of an applied film.

In the present invention, it is possible to add an antioxidant, a plasticizer, a lubricant, an ultraviolet absorbing agent, and a leveling agent in each of the charge generating layer, the charge transport layer, and the protective layer in order to improve resistance to environment, particularly, in order to prevent degradation of sensitivity and rise of a residual potential. Representative materials of these compounds are given below.

Examples of the antioxidant that can be added in the layers include, but are not limited to, phenol-based compounds, paraphenylenediamines, hydroquinones, organosulfur compounds, and organophosphorus compounds.

Examples of the plasticizer that can be added in the layers include, but are not limited to, phosphoric acid ester-based plasticizers, phthalic acid ester-based plasticizers, aromatic carboxylic acid ester-based plasticizers, aliphatic dibasic acid ester-based plasticizers, fatty acid ester derivatives, oxyester-based plasticizers, epoxy plasticizers, divalent alcohol ester-based plasticizers, chlorine-containing plasticizers, polyester-based plasticizers, sulfonic acid derivatives, and citric acid derivatives.

Examples of the lubricant that can be added in the layers include, but are not limited to, hydrocarbon-based compounds, fatty acid-based compounds, fatty acid amide-based compounds, ester-based compounds, alcohol-based compounds, metal soaps, natural waxes, silicone compounds, and fluorocompounds.

Examples of the ultraviolet absorbing agent that can be used in the layers include, but are not limited to, benzophenone-based ultraviolet absorbing agents, salicylate-based ultraviolet absorbing agents, benzotriazole-based ultraviolet absorbing agents, cyanoacrylate-based ultraviolet absorbing agents, quenchers (metal complex salt-based ultraviolet absorbing agents), and HALS (hindered amines).

[Electrophotographic Apparatus and Electrophotographic Method]

An electrophotographic apparatus of the present invention includes the photoconductor described above, a charging unit configured to charge a surface of the photoconductor, an image exposing unit configured to form an electrostatic latent image over the surface of the photoconductor, a developing unit configured to develop the electrostatic latent image to form a toner image, and a transfer unit configured to transfer the toner image onto a recording medium and further includes other units appropriately selected as needed. Examples of the other units include a cleaning unit, a charge eliminating unit, a recycling unit, and a controlling unit.

First Embodiment

Next, the electrophotographic apparatus and electrophotographic method of the present invention will be described in detail with reference to the drawings by raising specific examples.

Figure 5:
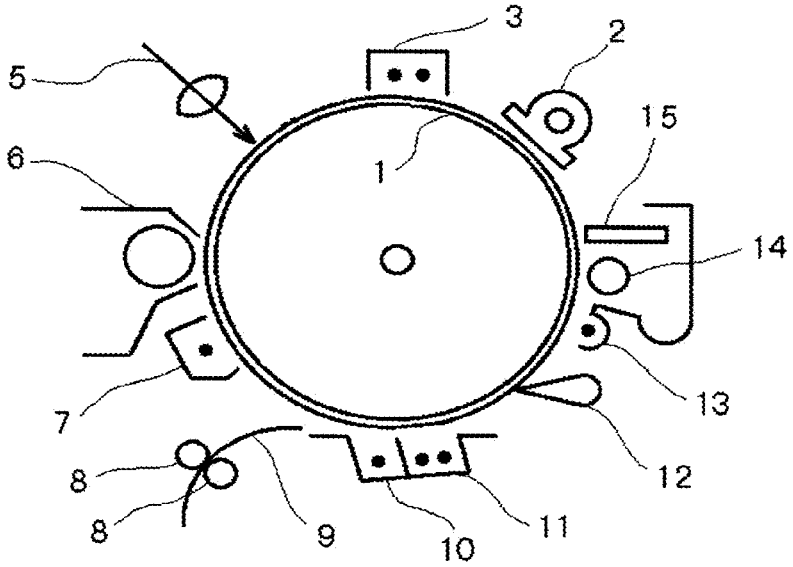
FIG. 5 is a schematic view illustrating an electrophotographic apparatus and an electrophotographic method of the present invention.

FIG. 5 is a schematic view illustrating the electrophotographic apparatus and electrophotographic method of the present invention and illustrating a configuration of the electrophotographic apparatus of the present invention according to a first embodiment.

In FIG. 5, a photoconductor 1 is the electrophotographic photoconductor of the present invention described above. The photoconductor 1 has a drum-like shape but may have a sheet-like shape and an endless belt-type shape. In the mode illustrated in FIG. 5, the drum-like photoconductor 1 is rotated in a counterclockwise direction of FIG. 1 by an unillustrated driving unit to have an image formed by respective units provided around the photoconductor 1 according to an electrophotographic method. The electrophotographic method will be described below in an order of steps of the electrophotographic method.

(Charging Unit and Charging Step)

First, a surface of the photoconductor 1 is uniformly charged by a charger 3, which is the charging unit. The charger 3 may be any of hitherto known chargers appropriately selected depending on the properties of the photoconductor 1 and a toner for development. Any charger may be used so long as the charger can charge the surface of the photoconductor 1 to a predetermined polarity (a positive polarity or a negative polarity) to a predetermined electric potential. Examples of the charger 3 include a corotron, a scorotron, a solid state charger, and a charging roller.

(Image Exposing Unit and Image Exposing Step)

Next, an electrostatic latent image is formed by an image exposing unit 5, which is the image exposing unit, over the surface of the photoconductor 1 uniformly charged. All kinds of light-emitting materials such as a fluorescent lamp, a tungsten lamp, a halogen lamp, a mercury lamp, a sodium-vapor lamp, a light-emitting diode (LED), a laser diode (LD), and electroluminescence (EL) may be used as the image exposing unit 5. It is preferable to use a light-emitting diode or a laser diode. For irradiation with only light in a desired wavelength range during image exposing, various filters such as a sharp cut filter, a band pass filter, a near infrared cut filter, a dichroic filter, an interference filter, and a color conversion filter may be disposed between the photoconductor 1 and the image exposing unit 5.

(Developing Unit and Developing Step)

The electrostatic latent image formed over the surface of the photoconductor 1 is developed with a toner by a developing unit 6, which is the developing unit. That is, the electrostatic latent image is developed by the developing unit 6 to form a toner image, which is a visible image. The developing unit 6 may be any of hitherto known developing units appropriately selected depending on the toner used. Examples of the developing unit 6 include one-component development and two-component development. Further, each of these systems includes a developing system for a magnetic toner and a develop system for a non-magnetic toner.

(Transfer Unit and Transferring Step)

The toner image borne over the photoconductor 1 is conveyed to a transfer charger 10, which is the transfer unit, along with the rotation of the photoconductor 1. The transfer charger 10 may be the same as the charger used as the charger 3 described above. However, as illustrated in FIG. 5, a combination of a transfer charger 10 and a separation charger 11 is effective. Further, in order to improve a transfer efficiency, it is preferable to provide a pre-transfer charger 7 at a position upstream from the transfer charger 10 (in the rotation direction of the photoconductor 1) to pre-charge the toner image. The pre-transfer charger 7 may be the same as the charger used as the charger 3 described above. Meanwhile, a transfer sheet 9, which is a recording medium, is conveyed by registration rollers 8, etc. to a position at which the photoconductor 1 and the transfer charger 10 face each other in a manner that the toner image will be transferred to a desired position on the transfer sheet 9. Then, the toner image is transferred onto the transfer sheet 9 by the transfer charger 10 when the toner image over the photoconductor 1 comes to a position to face the transfer sheet 9. The transfer sheet 9 onto which the toner image is transferred rotates along with the photoconductor 1 to reach a separation claw 12, is separated from the surface of the photoconductor 1 by the separation claw 12, and is ejected to outside the electrophotographic apparatus through conveying and fixing steps, which are not described.

(Cleaning Unit and Cleaning Step)

Here, adhered matters such as a toner image that has failed in being transferred to the transfer sheet 9, i.e., an untransferred remaining toner, paper dusts, etc. are present over the surface of the photoconductor 1 from which transferring has been performed by the transfer charger 10 and then the transfer sheet 9 has been separated by the separation claw 12. Hence, the adhered matters are removed from the surface of the photoconductor 1 by a fur brush 14 and a cleaning blade 15, which are the cleaning unit. The cleaning unit may be not only the fur brush 14 and the cleaning blade 15 but any hitherto known cleaning unit such as a magfur brush. Furthermore, it is also possible to use a fur brush or a cleaning blade alone. In order to improve a cleaning efficiency, it is preferable to pre-charge the photoconductor with a pre-cleaning charger 13 before subjecting the photoconductor to the cleaning unit. The pre-cleaning charger 13 may be the same as the charger used as the charger 3 described above.

(Charge Eliminating Unit and Charge Eliminating Step)

The photoconductor 1 from which the adhered matters over the surface have been removed by the cleaning unit has the surface irradiated with light by a charge eliminating lamp 2, which is the charge eliminating unit, to have charges eliminated from the surface, to complete the serial electrophotographic process by the electrophotographic method. It is possible to repeat this serial electrophotographic process by the electrophotographic method and have a plurality of recording media electrophotographed. The charge eliminating unit may be any hitherto known charge eliminating unit. For example, the charge eliminating lamp 2 may be the same as the lamp used as the image exposing unit 5 described above.

In the serial electrophotographic process by the electrophotographic method described above, the electrophotographic photoconductor 1 is charged positively (or negatively) and has an image exposed to light, which results in a positive (or negative) electrostatic latent image being formed over the surface of the photoconductor 1. When the electrostatic latent image is developed with a toner (electroscopic particles) having a negative (or positive) polarity, a positive image is obtained. When the electrostatic latent image is developed with a toner having a positive (or negative) polarity, a negative image is obtained. The charging polarity to which the electrophotographic photoconductor 1 is charged and the polarity of the toner used for development are optional and may be either. The various types of light sources used as the image exposing unit 5 are not limited to use in the mode illustrated in FIG. 5 and may be used in other steps in which light irradiation is used in combination, such as the transferring step, the charge eliminating step, the cleaning step, and a pre-exposing step.

Second Embodiment

Figure 6:
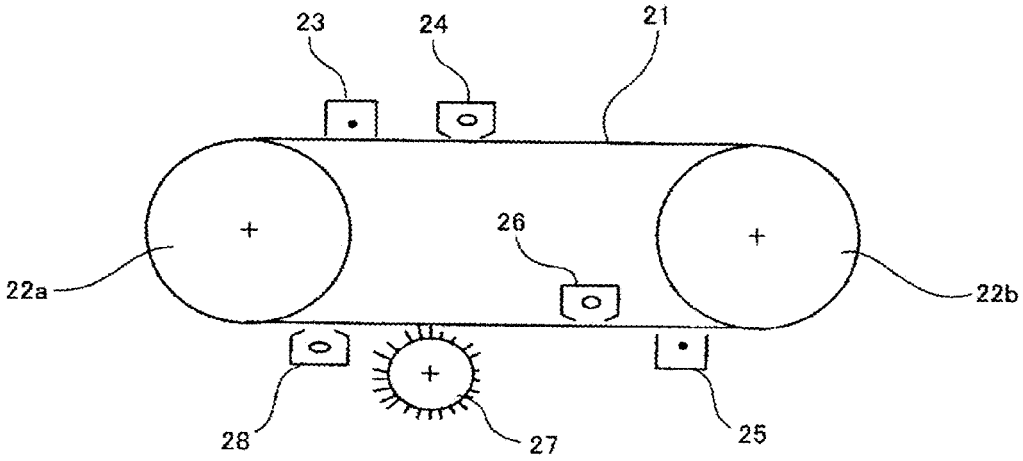
FIG. 6 is a schematic view illustrating a configuration of an electrophotographic apparatus of the present invention according to a second embodiment.

FIG. 6 is a schematic view illustrating a configuration of the electrophotographic apparatus of the present invention according to a second embodiment.

A photoconductor 21 includes at least a photoconductive layer (unillustrated) and is driven by driving rollers 22*a* and 22*b* to repeatedly undergo charging by a charging device 23, which is the charging unit, image exposure by a light source 24, which is the image exposing unit, development by the developing unit (unillustrated), transferring using a transfer charger 25, which is the transfer unit, pre-cleaning exposure by a light source 26, cleaning by a cleaning brush 27, which is the cleaning unit, and charge elimination by a light source 28, which is the charge eliminating unit. In FIG. 6, the photoconductor 21 (of which support is, needless to say, light-transmissive in this case) is irradiated with light for pre-cleaning exposure from a side of the photoconductor 21 at which the conductive support (unillustrated) is provided. The electrophotographic process by the electrophotographic method performed using the electrophotographic apparatus illustrated in FIG. 6 described above is an example embodiment of the present invention. Needless to say, any other embodiment is also possible. For example, in FIG. 6, the pre-cleaning exposure is performed from the side at which the conductive support (unillustrated) is provided. However, the pre-cleaning exposure may be performed from a side at which the photoconductive layer (unillustrated) is provided. Further, irradiation with image exposing light and charge eliminating light may be performed from the side at which the conductive support is provided. The image exposure, the pre-cleaning exposure, and the charge eliminating exposure are illustrated as steps in which light irradiation is performed. In addition, the photoconductor 21 may be subjected to light irradiation in pre-transferring exposure, pre-exposure before the image exposure, and any other known light irradiating step.

Third Embodiment

An embodiment of an electrophotographic printer (hereinafter simply referred to as printer) will be described as a full-color electrophotographic apparatus to which the present invention is applied.

Figure 7:
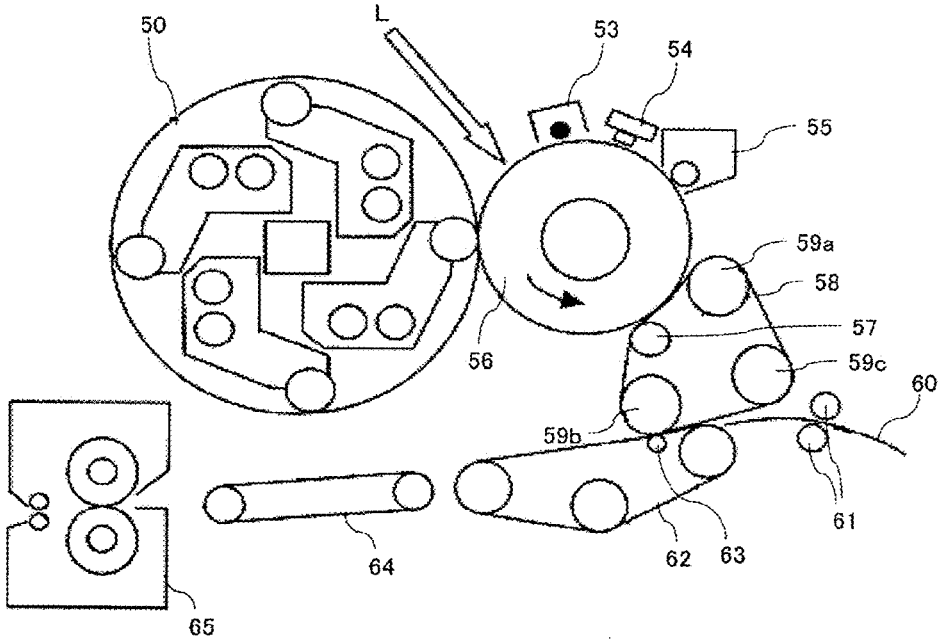
FIG. 7 is a schematic view illustrating a configuration of an electrophotographic apparatus of the present invention according to a third embodiment.

FIG. 7 is a schematic view illustrating a configuration of the electrophotographic apparatus of the present invention according to a third embodiment. In FIG. 7, a photoconductor drum 56, which is a latent image bearer, is driven to rotate in the counterclockwise direction of FIG. 7 to have a surface of the photoconductor drum 56 uniformly charged by a charger 53, which is the charging unit using a corotron, a scorotron, or the like, and then scanned with laser light L emitted by a laser optical device, which is the image exposing unit unillustrated, to bear an electrostatic latent image. The scanning is performed based on single-color image information, which is obtained by resolving a full-color image into color information for yellow, magenta, cyan, and black. Therefore, a single-color electrostatic latent image for yellow, magenta, cyan, or black is formed over the photoconductor drum 56. A revolver developing unit 50 is disposed at the left of the photoconductor drum 56 in FIG. 7. The revolver developing unit 50 includes a yellow developing device, a magenta developing device, a cyan developing device, and a black developing device, which are the developing unit, in a rotatable drum-like housing and is configured to rotate to move the respective developing devices to a developing position facing the photoconductor drum 56 in order. The yellow developing device, the magenta developing device, the cyan developing device, and the black developing device are configured to attach a yellow toner, a magenta toner, a cyan toner, and a black toner to electrostatic latent images to develop the electrostatic latent images. The electrostatic latent images for yellow, magenta, cyan, and black are formed in order over the photoconductor drum 56 and developed in order by the developing devices in the revolver developing unit 50 to become a yellow toner image, a magenta toner image, a cyan toner image, and a black toner image. An intermediate transfer unit is disposed at a position downstream from the developing position in the rotation of the photoconductor drum 56. The intermediate transfer unit is configured to drive a belt driving roller 59*c* to rotate such that an intermediate transfer belt 58, which is supported in a tense state by a tensile roller 59*a*, an intermediate transfer bias roller 57, which is the transfer unit, a secondary transfer backup roller 59*b*, and the belt driving roller 59*c*, endlessly moves in the clockwise direction of FIG. 7. The yellow toner image, the magenta toner image, the cyan toner image, and the black toner image developed over the photoconductor drum 56 proceed into an intermediate transfer nip at which the photoconductor drum 56 and the intermediate transfer belt 58 contact each other. Then, the yellow toner image, the magenta toner image, the cyan toner image, and the black toner image are intermediately transferred (primarily transferred) onto the intermediate transfer belt 58 under influence of a bias from the intermediate transfer bias roller 57 to be overlaid together and become a four-color overlaid toner image. The surface of the photoconductor drum 56 having passed through the intermediate transfer nip along with rotation has any untransferred, remaining toner cleaned by a drum cleaning unit 55, which is the cleaning unit. The drum cleaning unit 55 is configured to clean any untransferred, remaining toner with a cleaning roller to which a cleaning bias is applied, but may be a cleaning unit configured to use a cleaning brush constituted by a fur brush, a magfur brush, etc., a cleaning blade, or the like. The surface of the photoconductor drum 56 having any untransferred, remaining toner cleaned has then charges eliminated by a charge eliminating lamp 54, which is the charge eliminating unit. The charge eliminating lamp 54 may be any of a fluorescent lamp, a tungsten lamp, a halogen lamp, a mercury lamp, a sodium-vapor lamp, a light-emitting diode (LED), a laser diode (LD), electroluminescence (EL), etc. A semiconductor laser is used as a light source of the laser optical device mentioned above. Only a desired wavelength range of light emitted by these light sources may be used by means of various filters such as a sharp cut filter, a band pass filter, a near infrared cut filter, a dichroic filter, an interference filter, and a color conversion filter. In the meantime, a pair of registration rollers 61 nipping a transfer sheet 60, which is a recording medium sent forth from an unillustrated paper feeding cassette, between the two rollers bring forward the transfer sheet 60 to a secondary transfer nip at which the intermediate transfer belt 58 and a transfer belt 62 contact each other at a timing at which the transfer sheet can meet the four-color overlaid toner image over the intermediate transfer belt 58. In the secondary transfer nip, the four-color overlaid toner image over the intermediate transfer belt 58 is secondarily transferred onto the transfer sheet 60 simultaneously under influence of a secondary transfer bias from a sheet transfer bias roller 63, which is a secondary transfer unit. By the secondary transferring, a full-color image is formed over the transfer sheet 60. The transfer sheet 60 over which the full-color image is formed is sent to a conveying belt 64 by the transfer belt 62. The conveying belt 64 brings forward the transfer sheet 60 received from the transfer unit into a fixing unit 65. The fixing unit 65 conveys the transfer sheet 60 brought into while nipping the transfer sheet 60 in a fixing nip formed by contact of a heating roller and a backup roller with each other. The full-color image over the transfer sheet 60 is fixed over the transfer sheet 60 under influence of heating by the heating roller and a pressurizing force in the fixing nip.

Although unillustrated, a bias for causing the transfer sheet 60 to be attracted to the transfer belt 62 and the conveying belt 64 is applied to the transfer belt 62 and the conveying belt 64. Further, there are disposed a sheet-charge eliminating charger configured to eliminate charges from the transfer sheet 60 and three belt-charge eliminating chargers configured to eliminate charges from the belts (i.e., the intermediate transfer belt 58, the transfer belt 62, and the conveying belt 64). The intermediate transfer unit also includes a belt cleaning unit having the same configuration as the drum cleaning unit 55 to clean any untransferred, remaining toner over the intermediate transfer belt 58.

To sum, the electrophotographic apparatus of the present invention can include the intermediate transfer unit in addition to the transfer unit configured to perform transfer onto an intermediate transfer medium, such that the electrophotographic apparatus is configured to cause the transfer unit to primarily transfer the toner images formed over the electrophotographic photoconductor onto the intermediate transfer medium to form an image over the intermediate transfer medium and cause the intermediate transfer unit to secondarily transfer the image over the intermediate transfer medium onto the recording medium.

Here, when the image to be secondarily transferred onto the recording medium is a color image made of toners of a plurality of colors, the electrophotographic apparatus of the present invention can be configured to cause the transfer unit to overlay the toners of the colors in order over the intermediate transfer medium to form an image over the intermediate transfer medium and cause the intermediate transfer unit to secondarily transfer the image over the intermediate transfer medium onto the recording medium simultaneously.

Fourth Embodiment

Figure 8:
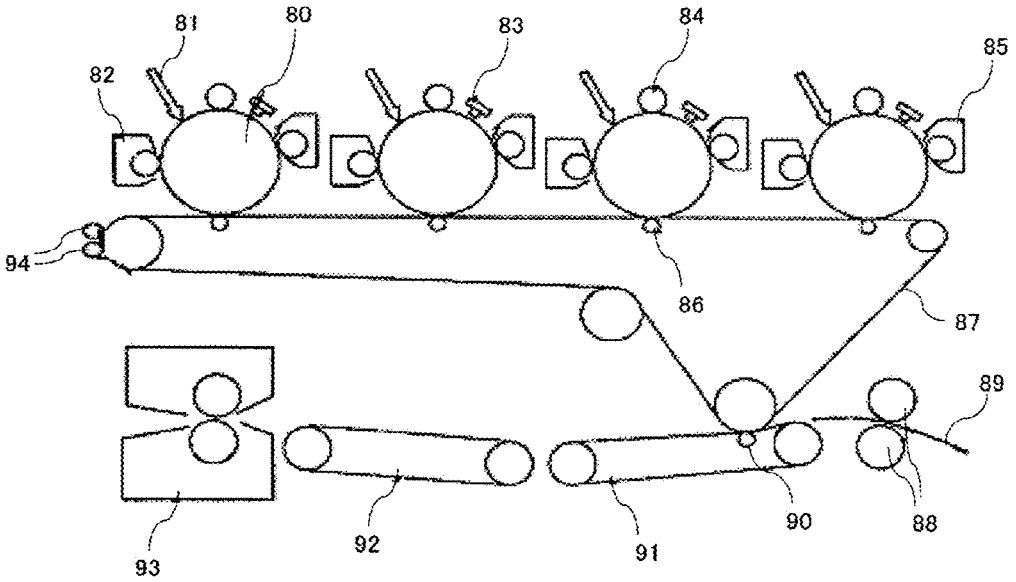
FIG. 8 is a schematic view illustrating a configuration of an electrophotographic apparatus of the present invention according to a fourth embodiment.

FIG. 8 is a schematic view illustrating a configuration of the electrophotographic apparatus of the present invention according to a fourth embodiment. The present embodiment is an electrophotographic apparatus of a tandem system including an intermediate transfer belt 87, and is not configured to have a photoconductor drum 80 used in common for a plurality of colors but includes photoconductor drums 80Y, 80M, 80C, and 80Bk for the colors. The electrophotographic apparatus also includes a developing unit (developing unit) 82, a drum cleaning unit (cleaning unit) 85, a charge eliminating lamp (charge eliminating unit) 83, a charging roller (charging unit) 84 configured to uniformly charge the drum, and a bias roller (primary transfer unit) 86 for each of the colors. The printer illustrated in FIG. 7 includes the charger 53 as a charging unit configured to uniformly charge the drum. Instead, the present apparatus includes the charging rollers 84. The apparatus also includes a fur brush 94 as a belt cleaning unit configured to clean the intermediate transfer belt 87. In addition, the apparatus also includes a pair of registration rollers 88, a sheet 89, which is a recording medium, a sheet transfer bias roller 90, which is a secondary transfer unit, a transfer belt 91, a conveying belt 92, and a fixing unit 93. These members are the same as in the third embodiment described above and are not described. The tandem system can perform formation (image exposing step) and development of the latent images of the colors in parallel. Therefore, the electrophotographic speed can be much higher than the revolver system.

[Process Cartridge]

The electrophotographic apparatus as described above may be incorporated in a copier apparatus, a facsimile apparatus, and a printer in a secured state but may also be incorporated in these apparatuses in a form of a process cartridge. The process cartridge is a single apparatus (part) including a built-in photoconductor, and in addition, at least one unit selected from the group consisting of a charging unit, an image exposing unit, a developing unit, a transfer unit, a cleaning unit, and a charge eliminating unit.

The shape, etc. of the process cartridge have varieties. A common example is illustrated in FIG. 9.

Figure 9:
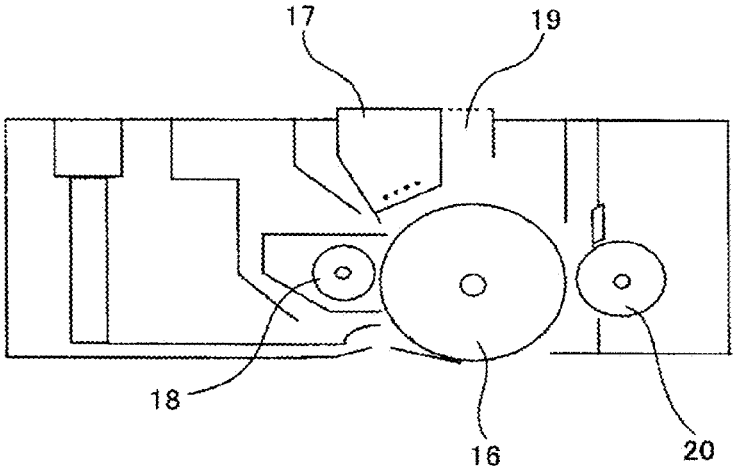
FIG. 9 is a schematic view illustrating a configuration of a process cartridge of the present invention according to an embodiment.

FIG. 9 is a schematic view illustrating a configuration of the process cartridge of the present invention according to an embodiment.

In the present embodiment, the process cartridge includes a photoconductor 16, a charger 17, which is the charging unit, an image exposing unit 19, which is the image exposing unit, a developing roller 20, which is the developing unit, and a cleaning brush 18, which is the cleaning unit.

EXAMPLES

The present invention will be described below by way of Examples. However, the present invention should not be construed as being limited to the Examples. Note that wherever the unit "part(s)" is indicated, the "part(s)" represents part(s) by mass.

Example 1

An intermediate layer coating liquid A was prepared using a method described below.

First, zinc oxide particles surface-treated to be coated with a salicylic acid derivative were produced according to a method described below.

Materials described below were mixed and stirred for 3 hours. Subsequently, the resultant was evacuated of toluene by distillation at reduced pressure and baked at 135° C. for 4 hours, to obtain surface-treated zinc oxide particles.

- Zinc oxide particles: zinc oxide produced by the wet method described above: 1,000 parts
- Salicylic acid derivative: a 3,5-di-t-butylsalicylic acid (available from Tokyo Chemical Industry Co., Ltd.): 10 parts
- Solvent: tetrahydrofuran: 5,100 parts Next, materials described below were mixed and subjected to dispersion for 10 hours using glass beads having a diameter of 0.3 mm and a vibrating-mill disperser, to prepare an intermediate layer coating liquid A.

- Surface-treated zinc oxide particles described above: 300 parts
- 20% by mass diluted liquid obtained by dissolving a binder resin which was a blocked isocyanate (SUMIDUR BL3175 available from Sumika Bayer Urethane Co., Ltd., with a solid content of 75% by mass) (60 parts) and a butyral resin (BM-S available from Sekisui Chemical Co., Ltd.) with 2-butanone: 225 parts
- Solvent: 2-butanone: 105 parts A randomly selected hundred particles among the surface-treated zinc oxide particles were observed with a transmission electron microscope (TEM), projected areas of the particles were obtained, and circle equivalent diameters of the obtained areas were calculated to obtain a volume average particle diameter as an average particle diameter. As a result, the average particle diameter was 85 nm.

The intermediate layer coating liquid A was applied over an aluminium cylinder by a dip coating method and then dried at 170° C. for 30 minutes to form an intermediate layer having a thickness of 21.0 μm.

An elastic power (We/Wt value) and a Martens hardness (HM) of the intermediate layer were measured under measuring conditions described below. As a result, the elastic power was 28.7% and the Martens hardness was 408.2 $N/mm^2$.

- Evaluator: H-100 available from Fischerscope K.K.
- Testing method: a test of repeating loading and unloading (once)
- Indenter: a micro Vickers indenter
- Maximum load: 9.8 mN
- Loading (unloading) time: 30 sec each
- Retention time: 5 sec
- Measuring conditions: 23° C., 55% RH A charge generating layer coating liquid B was prepared using a method described below.

Materials described below were mixed and subjected to dispersion for 10 hours using glass beads having a diameter of 1 mm and a bead-mill disperser, to prepare a charge generating layer coating liquid B.

Figure 10:
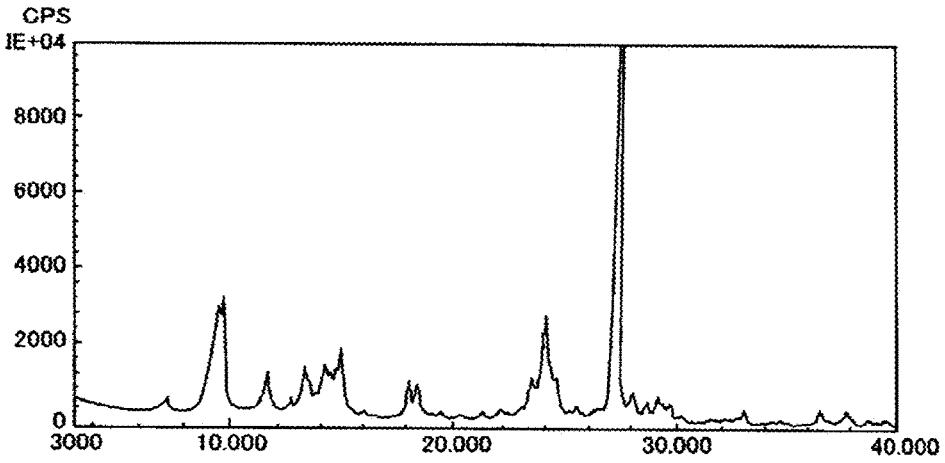
FIG. 10 is a graph of a powder X-ray diffraction spectrum of a Y-type titanyl phthalocyanine used in Examples.

- Charge generating substance: Y-type titanyl phthalocyanine: 8.5 parts
- Binder resin: a polyvinyl butyral (ESLEC BX-1 available from Sekisui Chemical Co., Ltd.): 5 parts
- Solvent: 2-butanone: 420 parts FIG. 10 plots a powder X-ray diffraction spectrum of the Y-type titanyl phthalocyanine used.

Subsequently, a charge transport layer coating liquid C was prepared using a method described below.

Materials described below were mixed and stirred until the materials were completely dissolved, to prepare a charge transport layer coating liquid C.

- Charge transport substance: a charge transport substance represented by a structural formula (1): 7 parts
- Binder resin: a polycarbonate (TS-2050 available from Teijin Chemicals Ltd.): 10 parts
- Leveling agent: a silicone oil (KF-50 available from Shin-Etsu Chemical Co., Ltd.): 0.0005 parts
- Solvent: tetrahydrofuran: 100 parts Structural Formula (1)

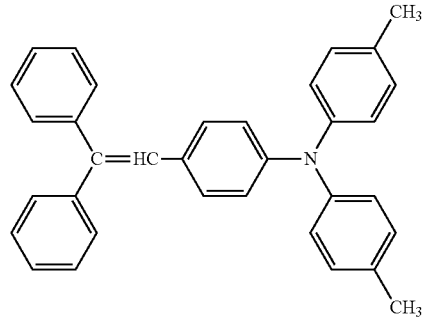

As described above, the intermediate layer coating liquid A was applied over an aluminium cylinder by a dip coating method and then dried at 170° C. for 30 minutes to form an intermediate layer having a thickness of 21 μm.

Next, the charge generating layer coating liquid B was applied by a dip coating method and then dried at 95° C. for 20 minutes to laminate a charge generating layer having a thickness of 0.2 μm.

Further, the charge transport layer coating liquid C was applied by a dip coating method and then dried at 135° C. for 20 minutes to laminate a charge transport layer having a thickness of 27 μm, to obtain an electrophotographic photoconductor.

Various properties of the electrophotographic photoconductor produced in the manner described above were measured and evaluated.

<Evaluation of Initial Electric Property and Electric Potential Shift after Repeating Cycle Test>

The electrophotographic photoconductor produced in the manner described above was charged by a scorotron method under conditions where a temperature was 23° C. and a humidity was 55% RH, and a discharging current was adjusted such that V0, which was a surface potential, would be −700±10 V. The value V0 and a value VL, which was an electric potential of an exposed portion of the surface of the photoconductor when irradiated with an exposing energy of 1.0 $\mu J/cm^2$ by a semiconductor laser having a wavelength of 780 nm, were measured during an initial period and after a repeating test of repeating 50,000 cycles.

[Evaluation Guideposts]

Preferable measurements of the value V0 in the initial period and after the repeating test of repeating 50,000 cycles are both 700 V±50 V. When the value V0 falls outside the range, an image density shift that can be judged visually would be observed.

When the value VL becomes higher than or equal to 150 V, image density degradation would occur.

When a rise (ΔVL) of the value VL after the repeating is greater than or equal to 50 V, image noise would occur.

<Image Qualities>

With a color laser printer (IPSIO SP C241 available from Ricoh Co., Ltd.) mounted with the electrophotographic photoconductor of each Example and Comparative Example produced, a test pattern having a density of 5% was printed over 50,000 sheets. Background fog and image density of the image over the 50,000th sheet were evaluated.

For background fog, the image of the test chart including a black solid portion in which printing was applied over the entire region and a white portion to which printing was not applied was evaluated for presence of absence, in the white portion (background portion), of background fog including black-spot-like flaws. For image density, an image quality based on the density at the black solid portion was evaluated according to the criteria below.

[Criteria for Evaluating Image Qualities]

Background fog

A: There were no apparent black spots in the white portion of the image.

B: There were black-spot-like flaws in the white portion of the image.

Image density

A: The density at the black solid portion of the image was sufficient.

B: The density at the black solid portion of the image was degraded.

These evaluations were conducted under normal temperature, normal humidity conditions of 23° C. and 55% RH and high temperature, high humidity conditions of 32° C. and 87% RH.

The results of the evaluations are presented in Table 1.

Also in each of Example 2 to Example 19 and Comparative Example 1 to Comparative Example 6 described below, a randomly selected hundred particles among surface-treated zinc oxide particles were observed with a transmission electron microscope (TEM), projected areas of the particles were obtained, and circle equivalent diameters of the obtained areas were calculated to obtain a volume average particle diameter as an average particle diameter. The results of this calculation are also presented in Table 1.

Example 2

An electrophotographic photoconductor was produced in the same manner as in Example 1 except that the surface-treating agent for the zinc oxide particles was changed from the 3,5-di-t-butylsalicylic acid used in Example 1 to 3-aminosalicylic acid (available from Tokyo Chemical Industry Co., Ltd.). The electrophotographic photoconductor produced was evaluated in the same manners as in Example 1 as Example 2.

An elastic power (We/Wt value) and a Martens hardness of the intermediate layer of the photoconductor used in Example 2 were measured in the same manner as in Example 1. As a result, the elastic power was 29.2% and the Martens hardness was 390.3 N/mm$^2$.

Example 3

An electrophotographic photoconductor was produced in the same manner as in Example 1 except that the surface-treating agent for the zinc oxide particles was changed from the 3,5-di-t-butylsalicylic acid used in Example 1 to 3,5-dinitrosalicylic acid (available from Tokyo Chemical Industry Co., Ltd.). The electrophotographic photoconductor produced was evaluated in the same manners as in Example 1 as Example 3.

An elastic power (We/Wt value) and a Martens hardness of the intermediate layer of the photoconductor used in Example 3 were measured in the same manner as in Example 1. As a result, the elastic power was 26.3% and the Martens hardness was 415.0 N/mm$^2$.

Example 4

An electrophotographic photoconductor was produced in the same manner as in Example 1 except that the binder resin-diluted liquid was changed from Example 1 as described below. The electrophotographic photoconductor produced was evaluated in the same manners as in Example 1 as Example 4.

20% by mass diluted liquid obtained by dissolving a binder resin which was a blocked isocyanate (DESMODUR BL3575 available from Sumika Bayer Urethane Co., Ltd., with a solid content of 75% by mass) (64 parts) and a butyral resin (BM-1 available from Sekisui Chemical Co., Ltd.) with 2-butanone: 225 parts An elastic power (We/Wt value) and a Martens hardness of the intermediate layer of the photoconductor used in Example 4 were measured in the same manner as in Example 1. As a result, the elastic power was 27.5% and the Martens hardness was 370.0 N/mm$^2$.

Example 5

An electrophotographic photoconductor was produced in the same manner as in Example 1 except that in the preparation of the intermediate layer coating liquid A, dispersion for 6 hours using zirconia beads having a diameter of 0.5 mm and a vibrating-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Example 5.

An elastic power (We/Wt value) and a Martens hardness of the intermediate layer of the photoconductor used in Example 5 were measured in the same manner as in Example 1. As a result, the elastic power was 20.5% and the Martens hardness was 429.6 N/mm$^2$.

Example 6

An electrophotographic photoconductor was produced in the same manner as in Example 1 except that in the preparation of the intermediate layer coating liquid A, dispersion for 24 hours using zirconia balls having a diameter of 2.0 mm and a ball-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Example 6.

An elastic power (We/Wt value) and a Martens hardness of the intermediate layer of the photoconductor used in Example 6 were measured in the same manner as in Example 1. As a result, the elastic power was 34.8% and the Martens hardness was 366.9 N/mm$^2$.

Example 7

An electrophotographic photoconductor was produced in the same manner as in Example 1 except that in the preparation of the intermediate layer coating liquid A, dispersion for 24 hours using zirconia balls having a diameter of 0.1 mm and a bead-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Example 7.

An elastic power (We/Wt value) and a Martens hardness of the intermediate layer of the photoconductor used in Example 7 were measured in the same manner as in Example 1. As a result, the elastic power was 32.8% and the Martens hardness was 398.0 N/mm$^2$.

Example 8

An electrophotographic photoconductor was produced in the same manner as in Example 1 except that in the preparation of the intermediate layer coating liquid A, dispersion for 6 hours using zirconia balls having a diameter of 0.3 mm and a vibrating-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Example 8.

An elastic power (We/Wt value) and a Martens hardness of the intermediate layer of the photoconductor used in Example 8 were measured in the same manner as in Example 1. As a result, the elastic power was 33.9% and the Martens hardness was 352.8 N/mm$^2$.

Example 9

An electrophotographic photoconductor was produced in the same manner as in Example 1 except that in the preparation of the intermediate layer coating liquid A, dispersion for 72 hours using zirconia balls having a diameter of 50 mm and a ball-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Example 9.

An elastic power (We/Wt value) and a Martens hardness of the intermediate layer of the photoconductor used in Example 9 were measured in the same manner as in Example 1. As a result, the elastic power was 22.8% and the Martens hardness was 443.8 N/mm$^2$.

Example 10

An electrophotographic photoconductor was produced in the same manner as in Example 1 except that the binder resin-diluted liquid was changed from Example 1 as described below. The electrophotographic photoconductor produced was evaluated in the same manners as in Example 1 as Example 10.

15% by mass diluted liquid obtained by dissolving a binder resin which was a blocked isocyanate (SUMIDUR BL3175 available from Sumika Bayer Urethane Co., Ltd., with a solid content of 75% by mass) (62 parts) and a butyral resin (BX-1 available from Sekisui Chemical Co., Ltd.) with 2-butanone: 260 parts An elastic power (We/Wt value) and a Martens hardness of the intermediate layer of the photoconductor used in Example 10 were measured in the same manner as in Example 1. As a result, the elastic power was 27.6% and the Martens hardness was 367.2 N/mm$^2$.

Example 11

An electrophotographic photoconductor was produced in the same manner as in Example 1 except that the binder resin-diluted liquid was changed from Example 1 as described below. The electrophotographic photoconductor produced was evaluated in the same manners as in Example 1 as Example 11.

20% by mass diluted liquid obtained by dissolving a binder resin which was a blocked isocyanate (DESMODUR BL4265 available from Sumika Bayer Urethane Co., Ltd., with a solid content of 65% by mass) (70 parts) and a butyral resin (BM-1 available from Sekisui Chemical Co., Ltd.) with 2-butanone: 260 parts An elastic power (We/Wt value) and a Martens hardness of the intermediate layer of the photoconductor used in Example 11 were measured in the same manner as in Example 1. As a result, the elastic power was 29.7% and the Martens hardness was 388.7 N/mm$^2$.

Example 12

An electrophotographic photoconductor was produced in the same manner as in Example 1 except that a dip coating speed during application of the intermediate layer coating liquid A by a dip coating method was changed from Example 1 to form an intermediate layer which would have a thickness of 12.0 μm after dried at 170° C. for 30 minutes. The electrophotographic photoconductor produced was evaluated in the same manners as in Example 1 as Example 12.

An elastic power (We/Wt value) and a Martens hardness of the intermediate layer of the photoconductor used in Example 12 were measured in the same manner as in Example 1. As a result, the elastic power was 26.6% and the Martens hardness was 419.2 N/mm$^2$.

Example 13

An electrophotographic photoconductor was produced in the same manner as in Example 1 except that a dip coating speed during application of the intermediate layer coating liquid A by a dip coating method was changed from Example 1 to form an intermediate layer which would have a thickness of 9.0 μm after dried at 170° C. for 30 minutes. The electrophotographic photoconductor produced was evaluated in the same manners as in Example 1 as Example 13.

An elastic power (We/Wt value) and a Martens hardness of the intermediate layer of the photoconductor used in Example 13 were measured in the same manner as in Example 1. As a result, the elastic power was 20.3% and the Martens hardness was 448.2 N/mm$^2$.

Example 14

An electrophotographic photoconductor was produced in the same manner as in Example 1 except that a dip coating speed during application of the intermediate layer coating liquid A by a dip coating method was changed from Example 1 to form an intermediate layer which would have a thickness of 51.0 μm after dried at 170° C. for 30 minutes. The electrophotographic photoconductor produced was evaluated in the same manners as in Example 1 as Example 14.

An elastic power (We/Wt value) and a Martens hardness of the intermediate layer of the photoconductor used in Example 14 were measured in the same manner as in Example 1. As a result, the elastic power was 34.8% and the Martens hardness was 351.2 N/mm$^2$.

Example 15

An electrophotographic photoconductor was produced in the same manner as in Example 1 except that a dip coating speed during application of the intermediate layer coating liquid A by a dip coating method was changed from Example 1 to form an intermediate layer which would have a thickness of 48.0 μm after dried at 170° C. for 30 minutes. The electrophotographic photoconductor produced was evaluated in the same manners as in Example 1 as Example 15.

An elastic power (We/Wt value) and a Martens hardness of the intermediate layer of the photoconductor used in Example 15 were measured in the same manner as in Example 1. As a result, the elastic power was 33.6% and the Martens hardness was 362.4 N/mm$^2$.

Example 16

An electrophotographic photoconductor was produced in the same manner as in Example 1 except that the zinc oxide particles used in Example 1 and produced by the wet method described above were changed to zinc oxide particles having an average primary particle diameter of 21 nm. The electrophotographic photoconductor produced was evaluated in the same manners as in Example 1 as Example 16.

An elastic power (We/Wt value) and a Martens hardness of the intermediate layer of the photoconductor used in Example 16 were measured in the same manner as in Example 1. As a result, the elastic power was 26. % and the Martens hardness was 397.8 N/mm$^2$.

Example 17

An electrophotographic photoconductor was produced in the same manner as in Example 1 except that the zinc oxide particles of Example 1 produced by the wet method described above were changed to zinc oxide particles having an average primary particle diameter of 18 nm. The electrophotographic photoconductor produced was evaluated in the same manners as in Example 1 as Example 17.

An elastic power (We/Wt value) and a Martens hardness of the intermediate layer of the photoconductor used in Example 17 were measured in the same manner as in Example 1. As a result, the elastic power was 32.4% and the Martens hardness was 360.2 N/mm$^2$.

Example 18

An electrophotographic photoconductor was produced in the same manner as in Example 1 except that the zinc oxide particles of Example 1 produced by the wet method described above were changed to zinc oxide particles having an average primary particle diameter of 192 nm. The electrophotographic photoconductor produced was evaluated in the same manners as in Example 1 as Example 18.

An elastic power (We/Wt value) and a Martens hardness of the intermediate layer of the photoconductor used in Example 18 were measured in the same manner as in Example 1. As a result, the elastic power was 31.0% and the Martens hardness was 384.1 N/mm$^2$.

Example 19

An electrophotographic photoconductor was produced in the same manner as in Example 1 except that the zinc oxide particles of Example 1 produced by the wet method described above were changed to zinc oxide particles having an average primary particle diameter of 209 nm. The electrophotographic photoconductor produced was evaluated in the same manners as in Example 1 as Example 19.

An elastic power (We/Wt value) and a Martens hardness of the intermediate layer of the photoconductor used in Example 19 were measured in the same manner as in Example 1. As a result, the elastic power was 29.6% and the Martens hardness was 397.7 N/mm$^2$.

Comparative Example 1

Materials described below were mixed and subjected to dispersion for 72 hours using zirconia balls having a diameter of 10 mm and a ball-mill disperser, to prepare an intermediate layer coating liquid R.

- Alkyd resin (BECKOLITE M-6401-50 available from DIC Corporation): 650 parts
- Amino resin (SUPERBECKAMINE G-821-60 available from DIC Corporation): 350 parts
- Titanium oxide having a particle diameter of 250 nm (CR-EL available from Ishihara Sangyo Kaisha, Ltd.): 220.0 parts
- Methyl ethyl ketone: 1,400 parts The intermediate layer coating liquid R was applied over an aluminium cylinder by a dip coating method and then dried at 135° C. for 30 minutes to form an intermediate layer having a thickness of 3.5 μm.

An elastic power (We/Wt value) and a Martens hardness of the intermediate layer were measured under the same measuring conditions as in Example 1. As a result, the elastic power was 17.2% and the Martens hardness was 642.3 N/mm$^2$.

As in Example 1, the charge generating layer coating liquid B was applied over the intermediate layer produced in the manner described above by a dip coating method and then dried at 95° C. for 20 minutes to laminate a charge generating layer having a thickness of 0.2 μm. Further, the charge transport layer coating liquid C was applied by a dip coating method and then dried at 135° C. for 20 minutes to laminate a charge transport layer having a thickness of 27 μm, to obtain an electrophotographic photoconductor for Comparative Example 1.

The electrophotographic photoconductor for Comparative Example 1 was evaluated in the same manners as in Example 1 as Comparative Example 1.

Comparative Example 2

An electrophotographic photoconductor was produced in the same manner as in Example 1 except that in the preparation of the intermediate layer coating liquid A, dispersion for 30 hours using zirconia balls having a diameter of 0.3 mm and a vibrating-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Comparative Example 2.

An elastic power (We/Wt value) and a Martens hardness of the intermediate layer of the photoconductor used in Comparative Example 2 were measured in the same manner as in Example 1. As a result, the elastic power was 33.5% and the Martens hardness was 319.4 N/mm$^2$.

Comparative Example 3

An electrophotographic photoconductor was produced in the same manner as in Example 1 except that in the preparation of the intermediate layer coating liquid A, dispersion for 96 hours using alumina balls having a diameter of 10 mm and a ball-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Comparative Example 3.

An elastic power (We/Wt value) and a Martens hardness of the intermediate layer of the photoconductor used in Comparative Example 3 were measured in the same manner as in Example 1. As a result, the elastic power was 18.7% and the Martens hardness was 443.7 N/mm$^2$.

Comparative Example 4

An electrophotographic photoconductor was produced in the same manner as in Example 1 except that in the preparation of the intermediate layer coating liquid A, dispersion for 72 hours using alumina balls having a diameter of 5 mm and a ball-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Comparative Example 4.

An elastic power (We/Wt value) and a Martens hardness of the intermediate layer of the photoconductor used in Comparative Example 4 were measured in the same manner as in Example 1. As a result, the elastic power was 21.4% and the Martens hardness was 467.3 N/mm$^2$.

Comparative Example 5

An electrophotographic photoconductor was produced in the same manner as in Example 1 except that in the preparation of the intermediate layer coating liquid A, dispersion for 108 hours using zirconia balls having a diameter of 5 mm and a ball-mill disperser was performed instead of dispersion for 10 hours using glass beads having a diameter of 0.3 mm and a vibrating-mill disperser as in Example 1. The electrophotographic photoconductor produced was evaluated in the same manners as in Example 1 as Comparative Example 5.

An elastic power (We/Wt value) and a Martens hardness of the intermediate layer of the photoconductor used in Comparative Example 5 were measured in the same manner as in Example 1. As a result, the elastic power was 36.2% and the Martens hardness was 352.1 N/mm$^2$.

Comparative Example 6

An electrophotographic photoconductor was produced in the same manner as in Example 1 except that the binder resin-diluted liquid was changed from Example 1 as described below and the intermediate layer coating liquid R was applied over an aluminium cylinder by a dip coating method and then dried at 110° C. for 15 minutes to form an intermediate layer having a thickness of 2.5 μm unlike in Example 1. The electrophotographic photoconductor produced was evaluated in the same manners as in Example 1 as Comparative Example 6.

5.1% by mass diluted liquid obtained by dissolving a binder resin which was a copolymerized nylon resin (AMMAN CM-8000 available from Toray Industries, Inc.) with a 7:3 methanol:butanol solution: 260 parts An elastic power (We/Wt value) and a Martens hardness of the intermediate layer of the photoconductor used in Comparative Example 6 were measured in the same manner as in Example 1. As a result, the elastic power was 69.3% and the Martens hardness was 253.4 N/mm$^2$.

TABLE 1

| | | | Intermediate layer | Average particle | Initial electric properties | | Electric properties after 50,000 cycles | | VL rise | Image qualities after 50,000 cycles Under 23° C./55% RH | | Image qualities after 50,000 cycles Under 32° C./87% RH | |
|---|---|---|---|---|---|---|---|---|---|---|---|---|---|
| | Elastic power | Martens hardness | thickness (μm) | diameter (nm) | VO (−V) | VL (−V) | VO (−V) | VL (−V) | ΔVL (V) | Back-ground fog | Image density | Back-ground fog | Image density |
| Ex. 1 | 28.7 | 408.2 | 21.0 | 85 | 704 | 55 | 698 | 86 | 31 | A | A | A | A |
| Ex. 2 | 29.2 | 390.3 | 21.0 | 85 | 710 | 56 | 714 | 77 | 21 | A | A | A | A |
| Ex. 3 | 26.3 | 415.0 | 21.0 | 85 | 701 | 57 | 722 | 84 | 27 | A | A | A | A |
| Ex. 4 | 27.5 | 370.0 | 21.0 | 80 | 709 | 79 | 710 | 116 | 37 | A | A | A | A |
| Ex. 5 | 20.5 | 429.6 | 21.0 | 65 | 705 | 89 | 722 | 94 | 5 | A | A | A | A |
| Ex. 6 | 34.8 | 366.9 | 21.0 | 80 | 703 | 87 | 734 | 122 | 35 | A | A | A | A |
| Ex. 7 | 32.8 | 398.0 | 21.0 | 69 | 703 | 42 | 672 | 43 | 1 | A | A | A | A |
| Ex. 8 | 33.9 | 352.8 | 21.0 | 77 | 707 | 44 | 668 | 48 | 4 | A | A | A | A |
| Ex. 9 | 22.8 | 443.8 | 21.0 | 69 | 705 | 38 | 681 | 56 | 18 | A | A | A | A |
| Ex. 10 | 27.6 | 367.2 | 22.0 | 98 | 704 | 72 | 731 | 110 | 38 | A | A | A | A |
| Ex. 11 | 29.7 | 388.7 | 22.0 | 88 | 706 | 66 | 736 | 76 | 10 | A | A | A | A |
| Ex. 12 | 26.6 | 419.2 | 12.0 | 95 | 704 | 53 | 731 | 68 | 15 | A | A | A | A |
| Ex. 13 | 20.3 | 448.2 | 9.0 | 95 | 699 | 48 | 726 | 60 | 12 | A | A | A | A |

TABLE 1-continued

| | Elastic power | Martens hardness | Intermediate layer thickness (μm) | Average particle diameter (nm) | Initial electric properties VO (−V) | Initial electric properties VL (−V) | Electric properties after 50,000 cycles VO (−V) | Electric properties after 50,000 cycles VL (−V) | VL rise ΔVL (V) | Image qualities after 50,000 cycles Under 23° C./55% RH Back-ground fog | Image qualities after 50,000 cycles Under 23° C./55% RH Image density | Image qualities after 50,000 cycles Under 32° C./87% RH Back-ground fog | Image qualities after 50,000 cycles Under 32° C./87% RH Image density |
|---|---|---|---|---|---|---|---|---|---|---|---|---|---|
| Ex. 14 | 34.8 | 351.2 | 51.0 | 95 | 702 | 77 | 714 | 90 | 13 | A | A | A | A |
| Ex. 15 | 33.6 | 362.4 | 48.0 | 95 | 697 | 70 | 722 | 73 | 3 | A | A | A | A |
| Ex. 16 | 26.7 | 397.8 | 21.0 | 21 | 708 | 49 | 699 | 64 | 15 | A | A | A | A |
| Ex. 17 | 32.4 | 360.2 | 21.0 | 18 | 698 | 48 | 721 | 88 | 40 | A | A | A | A |
| Ex. 18 | 31.0 | 384.1 | 21.0 | 192 | 720 | 59 | 702 | 71 | 12 | A | A | A | A |
| Ex. 19 | 29.6 | 397.7 | 21.0 | 209 | 704 | 81 | 714 | 108 | 27 | A | A | A | A |
| Comp. Ex. 1 | 17.2 | 642.3 | 3.5 | 69 | 709 | 150 | 704 | 360 | 210 | A | B | B | B |
| Comp. Ex. 2 | 33.5 | 319.4 | 21.0 | 86 | 707 | 114 | 781 | 324 | 210 | A | B | A | B |
| Comp. Ex. 3 | 18.7 | 443.7 | 21.0 | 78 | 706 | 137 | 789 | 204 | 67 | A | B | A | B |
| Comp. Ex. 4 | 21.4 | 467.3 | 21.0 | 67 | 692 | 58 | 770 | 355 | 297 | A | B | B | B |
| Comp. Ex. 5 | 36.2 | 352.1 | 21.0 | 69 | 709 | 65 | 481 | 42 | −23 | B | A | B | A |
| Comp. Ex. 6 | 69.3 | 253.4 | 2.5 | 85 | 707 | 69 | 624 | 441 | 372 | B | B | B | B |

From the results of Table 1, it can be seen that the electrophotographic photoconductor of the present invention can maintain stable image qualities even after repeated use under various conditions.

What is claimed is:

1. A photoconductor comprising;

a conductive support;

an intermediate layer that comprises metal oxide particles; and a photoconductive layer, the intermediate layer and the photoconductive layer being provided over the conductive support in an order of reciting, wherein an elastic power (We/Wt value) of the intermediate layer is greater than or equal to 20.0% but less than 35.0%, and wherein a Martens hardness (HM) of the intermediate layer is greater than or equal to 350 [N/mm$^2$] but less than 450 [N/mm$^2$].

2. The photoconductor according to claim 1, wherein the intermediate layer comprises:

zinc oxide particles coated with a salicylic acid derivative; and a thermosetting resin.

3. The photoconductor according to claim 2, wherein an average particle diameter of the zinc oxide particles is greater than or equal to 50 nm but less than or equal to 200 nm.

4. The photoconductor according to claim 1, wherein a film thickness of the intermediate layer is greater than or equal to 10 μm but less than 50 μm.

5. An electrophotographic method comprising subjecting the photoconductor according to claim 1 to charging, image exposing, developing, and transferring.

6. An electrophotographic apparatus comprising:

a charging unit;

an image exposing unit;

a developing unit;

a transfer unit; and the photoconductor according to claim 1.

7. An electrophotographic process cartridge comprising the photoconductor according to claim 1.

8. The photoconductor according to claim 1, wherein the metal oxide particles comprise zinc oxide particles coated with a salicylic acid.

* * * * *